US011004294B2

(12) United States Patent
Hongo et al.

(10) Patent No.: US 11,004,294 B2
(45) Date of Patent: May 11, 2021

(54) COIN BATCH LOADING DEVICE

(71) Applicant: NIPPON CONLUX CO., LTD., Sakado (JP)

(72) Inventors: Fuminori Hongo, Sakado (JP); Masashi Kondo, Sakado (JP); Akihiro Nobuhara, Sakado (JP); Kiyoshi Oishi, Sakado (JP); Yohei Ishijima, Sakado (JP)

(73) Assignee: NIPPON CONLUX CO., LTD., Sakado (JP)

( * ) Notice: Subject to any disclaimer, the term of this patent is extended or adjusted under 35 U.S.C. 154(b) by 2 days.

(21) Appl. No.: 16/349,851

(22) PCT Filed: Oct. 2, 2017

(86) PCT No.: PCT/JP2017/035864

§ 371 (c)(1),
(2) Date: May 14, 2019

(87) PCT Pub. No.: WO2018/096793

PCT Pub. Date: May 31, 2018

(65) Prior Publication Data

US 2020/0074782 A1 Mar. 5, 2020

(30) Foreign Application Priority Data

Nov. 22, 2016 (JP) ..... JP2016-226805

(51) Int. Cl.

| | |
|---|---|
| ***G07D 11/10*** | (2019.01) |
| ***G07D 11/237*** | (2019.01) |
| ***G07D 1/00*** | (2006.01) |
| ***G07D 9/06*** | (2006.01) |
| ***G07D 3/06*** | (2006.01) |

(Continued)

(52) U.S. Cl.

CPC ..... *G07D 11/10* (2019.01); *G07D 1/00* (2013.01); *G07D 3/06* (2013.01); *G07D 3/128* (2013.01);

(Continued)

(58) Field of Classification Search

CPC .. G07D 1/00; G07D 1/02; G07D 1/04; G07D 1/06; G07D 1/08; G07D 3/00; G07D 3/02;

(Continued)

(56) References Cited

U.S. PATENT DOCUMENTS 4,164,232 A 8/1979 Nakai et al.
4,586,522 A * 5/1986 Taipale ..... G07D 9/008 453/10

(Continued)

FOREIGN PATENT DOCUMENTS

CN 101095172 A 12/2007
CN 104809797 A 7/2015

(Continued)

OTHER PUBLICATIONS

Communication dated Jul. 13 2020, from the European Patent Office in European Application No. 17873834.0.

(Continued)

*Primary Examiner* — Jeffrey A Shapiro
(74) *Attorney, Agent, or Firm* — Sughrue Mion, PLLC

(57) ABSTRACT

The coin batch loading device of the present invention is a coin batch loading device capable of separating out coins one by one which were input as a batch and delivering them, including a cylindrical portion having an opening at the top and a side wall and a bottom wall, a rotor which is disposed inside the cylindrical portion and rotates about the center of the cylindrical portion, outer periphery sensors provided inside the cylindrical portion which detect one or more coins on an outer perimeter portion of the rotor, and a control device for controlling the rotation of the rotor, wherein if one or more outer periphery sensors detect one or more coins, the control device is able to set the rotational speed of the rotor to a medium speed which is lower than a high speed.

8 Claims, 17 Drawing Sheets

(51) Int. Cl.
*G07D 3/14* (2006.01)
*G07D 9/00* (2006.01)
*G07D 3/12* (2006.01)

(52) U.S. Cl.
CPC ..... *G07D 3/14* (2013.01); *G07D 9/008* (2013.01); *G07D 9/06* (2013.01); *G07D 11/237* (2019.01); *G07D 2201/00* (2013.01)

(58) Field of Classification Search
CPC .. G07D 3/04; G07D 3/06; G07D 3/08; G07D 3/10; G07D 3/12; G07D 3/121; G07D 3/123; G07D 3/125; G07D 3/126; G07D 3/128; G07D 3/14; G07D 3/16; G07D 9/008; G07D 13/00; G07D 11/10; G07D 11/237; G07D 2201/00
USPC ..... 453/6, 10, 12, 13, 33–35, 49, 57
See application file for complete search history.

(56) References Cited

U.S. PATENT DOCUMENTS 8,360,270 B1 * 1/2013 McClosky ..... G07F 11/44 221/2
9,916,709 B2 * 3/2018 Kondo ..... G07D 3/16
2003/0057644 A1 * 3/2003 Shirasawa ..... G07D 9/008 273/138.1
2008/0085671 A1 * 4/2008 Nishida ..... G07D 1/00 453/57
2012/0295528 A1 * 11/2012 Itou ..... G07D 9/008 453/57
2015/0213665 A1 * 7/2015 Umeda ..... G07D 9/008 453/57
2018/0005477 A1 * 1/2018 Kondo ..... G07D 9/008

FOREIGN PATENT DOCUMENTS

JP 53-28787 U 3/1978
JP 7-85336 A 3/1995
JP 11-250297 A 9/1999
JP 2012-256243 A 12/2012
JP 2014-191804 A 10/2014
JP 2016-115267 A 6/2016

OTHER PUBLICATIONS

International Search Report for PCT/JP2017/035864 dated Dec. 26, 2017 (PCT/ISA/210).

* cited by examiner

COIN BATCH LOADING DEVICE

CROSS REFERENCE TO RELATED APPLICATIONS

This application is a National Stage of International Application No. PCT/JP2017/035864 filed Oct. 2, 2017, claiming priority based on Japanese Patent Application No. 2016-226805 filed Nov. 22, 2016.

TECHNICAL FIELD

The present invention relates to a coin batch loading device.

BACKGROUND ART

Conventionally, in a coin batch loading device that separates out one by one coins thrown in collectively and feeds them out, coins are conveyed along the inner circumferential wall of a cylindrical portion by the rotation of a rotor disposed inside the cylindrical portion dropped into coin dropping holes one by one (see Patent Document 1).

In a conventional coin batch loading device, by detecting an increase in motor current in the rotation of the rotor, a coin jam is detected, and when a coin jam is detected, the rotor is controlled by being reversed and then returned to forward rotation.

PRIOR ART DOCUMENTS

Patent Documents

[Patent Document 1] Japanese Unexamined Patent Application 2016-115267

DISCLOSURE OF INVENTION

Summary of the Invention

However, because a conventional coin batch loading device detects a coin jam by detecting an increase in motor current, if the rotor does not lock even if a coin jam occurs, then due to the fact that the motor current does not rise, a coin jam cannot be correctly detected. Therefore, shifting control to unjam the coins is not possible, time may be needed to separate and feed the coins one by one after throwing the coins in all at once.

Also, with conventional coin batch loading devices, depending on the amount of coins thrown in at once, separating and feeding the coins one by one after throwing the coins all at once may take time.

Therefore, for conventional coin batch loading devices, there is room to improve the delivery efficiency (time from input to delivery per coin) by shortening the time from when the coins are put in as a batch to when the coins are separated one by one and are delivered.

The present invention has been made in view of the above-described circumstances, and an object thereof is to provide a coin batch loading device with high delivery efficiency.

In order to achieve the above object, the following configuration has been developed.

(1) The coin batch loading device of the present invention is a coin batch loading device capable of separating out coins one by one which were input as a batch and delivering them comprising a cylindrical portion having an opening at the top and a side wall and a bottom wall, a rotor which is disposed inside the cylindrical portion and whose center of rotation is the center of the cylindrical portion, outer periphery sensors provided inside the cylinder which detect one or more coins on an outer perimeter portion of the rotor, and a control device which controls the rotation of the rotor, wherein if one or more outer periphery sensors detect one or more coins, the control device is able to set the rotational speed of the rotor to a medium speed which is lower than a high speed.

(2) According to the above configuration (1), the cylindrical portion includes a lid which can be opened and closed with respect to the opening, wherein the lid has an insertion slot and one or more insertion sensors which detect that one or more coins have been inserted, and wherein when the control devices by means of the one or more insertion sensors detect the insertion of one or more coins, the control device is able to increase the rotational speed of the rotor until outer periphery sensors detect the one or more coins.

(3) According to the above configurations (1) or (2), wherein a plurality of outer periphery sensors are spaced apart from each other in the circumferential direction of the cylindrical portion, and if in any one of the plurality of outer periphery sensors the time in which one or more coins is continuously detected exceeds a threshold, a coin jam is determined to have occurred, and if a coin jam is determined to have occurred, then the control device reversely rotates the rotor for a predetermined time and thereafter returns the rotor to forward rotation.

(4) According to the above configurations (1) or (2), wherein a plurality of outer periphery sensors are spaced apart from each other in the circumferential direction of the cylindrical portion, and the control device is any one of the plurality of outer periphery sensors, and wherein if the time when one or more coins are detected continuously exceeds a threshold, or alternatively, if the motor current driving the rotor exceeds a threshold value, a coin jam is determined to have occurred, and then when a coin jam is determined to have occurred, the rotor is reversely rotated for a predetermined time, and thereafter, returns the rotor to forward rotation.

(5) According to any of the above configurations (1) to (4), wherein the outer periphery sensor comprises at least a first outer periphery sensor, a second outer periphery sensor, and a third outer periphery sensor.

(6) According to the above configuration (5), the third outer periphery sensor is disposed near a coin outlet.

(7) According to the above configurations (5) or (6), wherein for the cylindrical portion, a diameter sensor is provided inside the cylindrical portion for detecting one or more coins above the rotor, and if the time per unit time during which one or more coins is detected in all of the diameter sensor, the first outer periphery sensor, and the second outer periphery sensor exceeds a threshold, a large amount of coins is determined to be present, and if a large amount of coins is determined to be present, then the control device is able to set the rotational speed of the rotor to be lower than medium speed.

(8) According to any of the above configurations (3) to (7), the time is calculated based on the number of detections performed in a predetermined cycle.

(9) According to any of the above configurations (1) to (8), the coin batch loading device includes a sorting unit that communicates with the coin outlet of the cylindrical portion and capable of identifying one or more coins' type, and wherein a plurality of outer periphery sensors are spaced apart from each other in the circumferential direction of the cylindrical portion, and wherein if in any one of the plurality of outer periphery sensors the time when one or more coins is continuously detected exceeds a threshold, if a motor current driving the rotor exceeds a threshold, or if the time in which the sorting unit continuously identifies a state in which a plurality of coins overlap in the vicinity from the coin outlet to the sorting unit exceeds a threshold, then a coin jam is determined to have occurred, and if a coin jam is determined to have occurred, then the control device reversely rotates the rotor for a predetermined time and thereafter returns the rotor to forward rotation.

Advantages of the Invention

According to the present invention, providing a coin batch loading device with high delivery efficiency is possible.

DETAILED DESCRIPTION OF EMBODIMENTS OF THE INVENTION

First Embodiment

Hereinafter, a first configuration (hereinafter, first embodiment) for carrying out the present invention will be described in detail with reference to the drawings. Note that like numbers refer to like elements throughout the description of the embodiments. Also, in the following, unless otherwise specified, the rotational axis direction of the rotor is the vertical direction, the opening side of the cylindrical portion is the upper side, and the bottom wall side of the cylindrical portion is the lower side. The rotational speed of the rotor is expressed as a relative ratio where the maximum value of the rotational speed of the rotor obtained from the motor output is 100%. The clockwise direction (the direction of the arrow a in FIG. 3) in the plan view is taken as the forward direction of the rotor.

Figure 1:
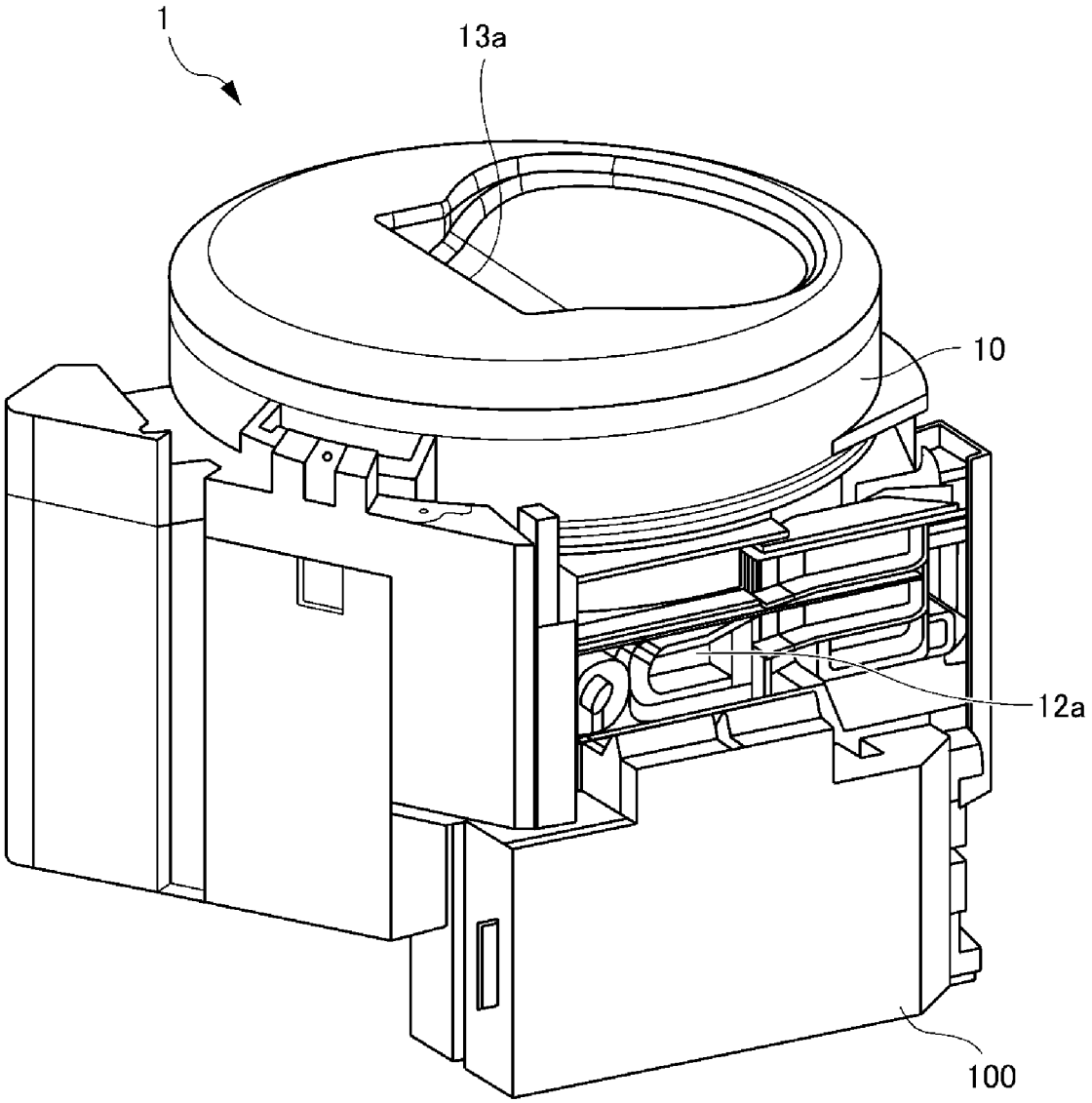
FIG. 1 is a perspective view of a coin batch loading device.

FIG. 1 is a perspective view of a coin batch loading device.

Figure 2:
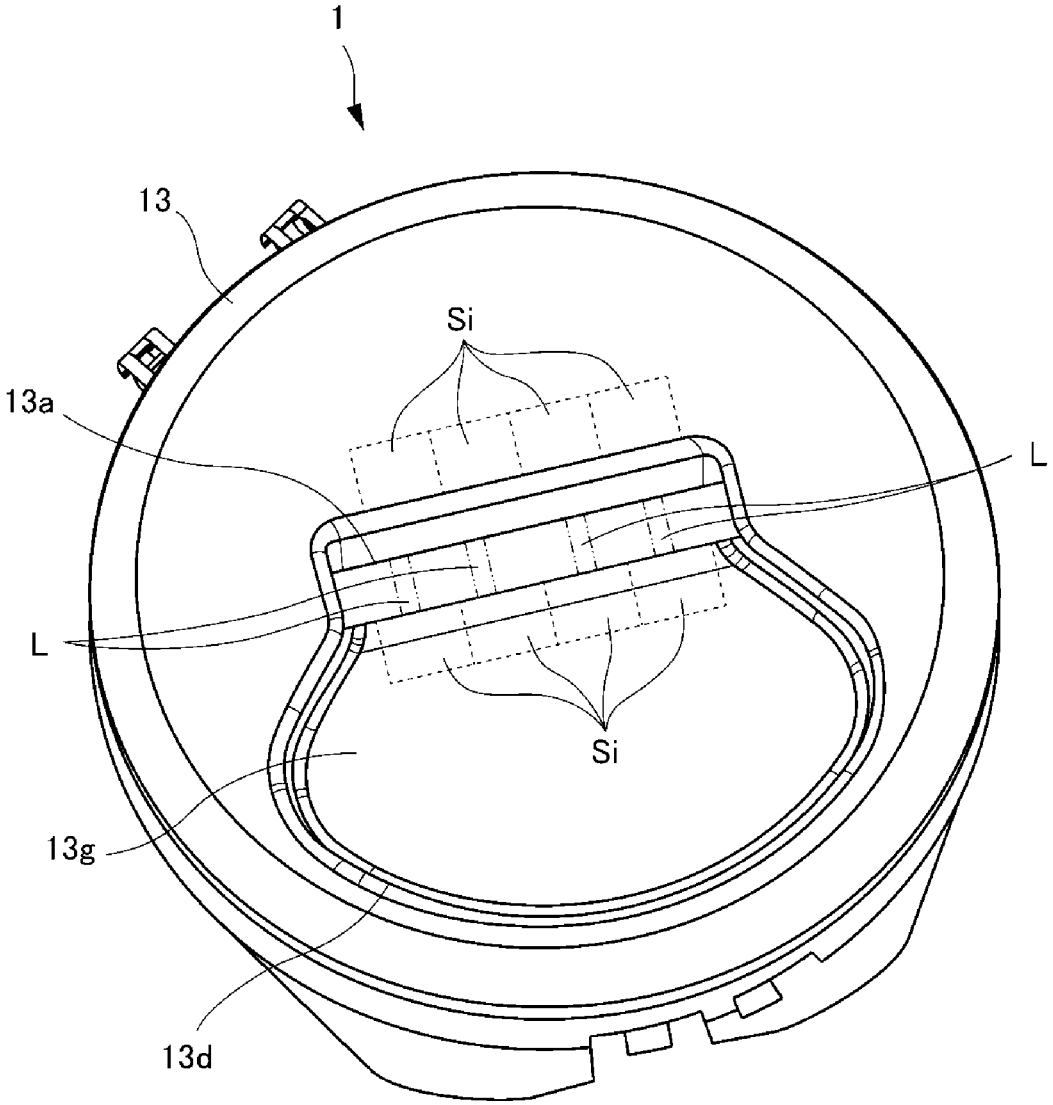
FIG. 2 is a top view of a coin batch loading device with a closed lid.

FIG. 2 is a top view of a coin batch loading device with a closed lid.

Figure 3:
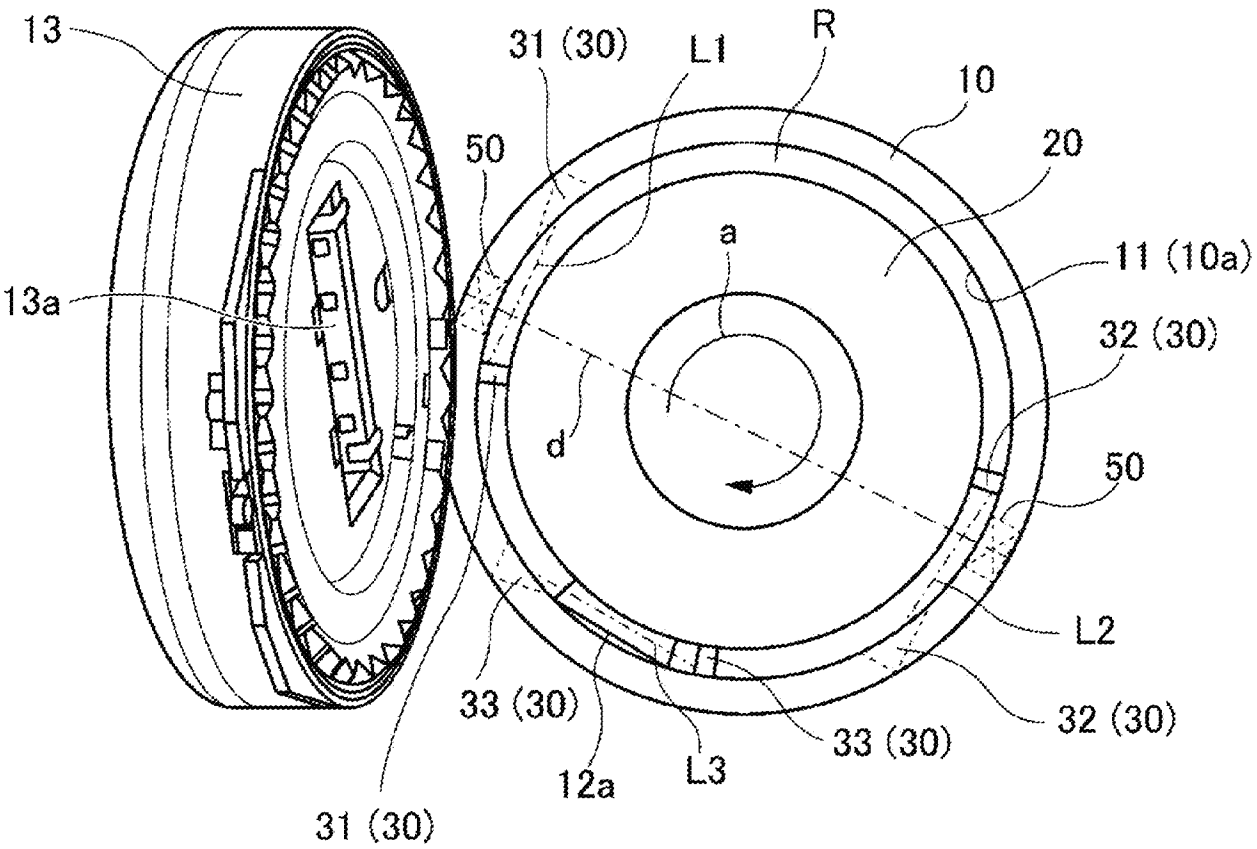
FIG. 3 is a top view of a coin batch loading device with an open lid.

FIG. 3 is a top view of a coin batch loading device with an open lid.

As shown in FIG. 1, a coin batch loading device 1 comprises a cylindrical portion 10 with an insertion slot 13*a*, and a sorting unit 100 for identifying and sorting types of coins which is in communication with a coin outlet 12*a* of the cylindrical portion 10. Then, coins inserted from the insertion slot 13*a* pass through the inside of cylindrical portion 10 and are fed one by one from the coin outlet 12*a* into the sorting unit 100 which identifies the type of coin and is able to sort according to the type of coin.

Specifically, as shown in FIG. 3, the coin batch loading device 1 comprises a cylindrical portion 10 having an opening 10*a* at the top and a side wall 11 (see FIG. 17) and a bottom wall 12 (see FIG. 17), a rotor 20 which is disposed inside the cylindrical portion 10 and rotates about the center of the cylindrical portion 10, outer periphery sensors 30 provided inside the cylindrical portion 10 for detecting coins on the outer periphery of the rotor 20, and a control device 40 (not shown) for controlling the rotation of the rotor 20.

Cylindrical Portion

Figure 17:
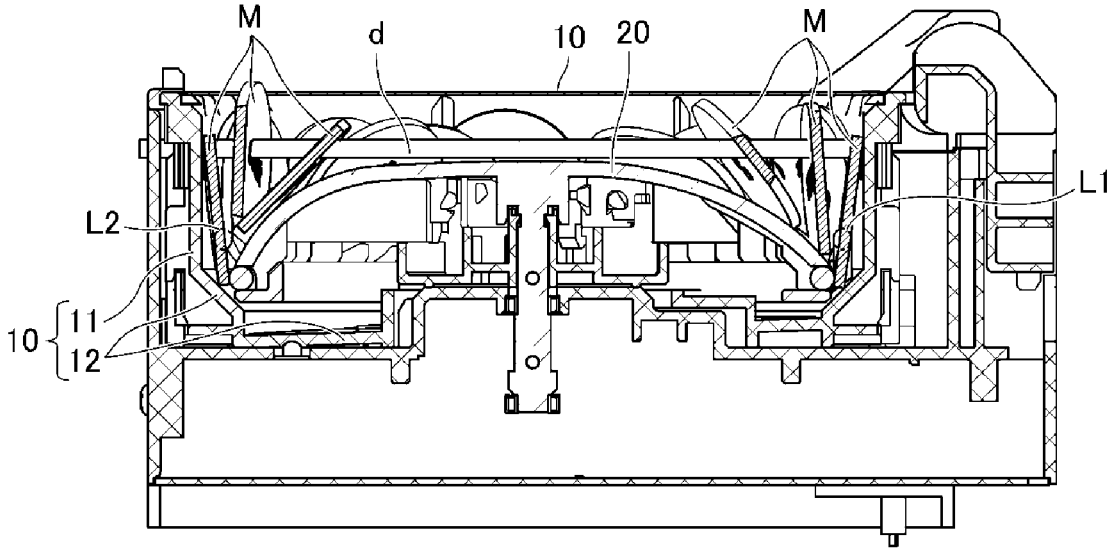
FIG. 17 is a cross-sectional view taken along arrow view X in FIG. 16.

The cylindrical portion 10 has an opening 10*a* at the top, a side wall 11 and a bottom wall 12 (see FIG. 17).

The rotor 20 is disposed inside the cylindrical portion 10. Note that the cylindrical portion 10 may be provided with a gear, a motor and a power supply unit (not shown) for transmitting power to rotate the rotor 20, and a control device 40 may be provided to control the rotational speed of the rotor 20. The gear, the motor, the power supply unit, and the control device 40 may be housed, for example, in a housing provided at the lower part of the rotor 20 and at the lower part of the bottom wall 12.

A lid 13 capable of opening and closing the opening 10*a* is attached to the cylindrical portion 10, and during normal use, as shown in FIG. 2, the lid 13 can be in a closed state, and for maintenance or the like, as shown in FIG. 3, the lid 13 can be in an open state.

The lid 13 has an outer peripheral shape slightly larger than the opening 10*a* of the cylindrical portion 10 and as a whole has a substantially disk shape.

As shown in FIG. 2, an elongated insertion slot 13*a* is provided substantially at the center of the lid 13. On the top surface of the lid 13, a recessed portion 13*d* is provided which extends out from the insertion slot 13*a*. The recessed portion 13*d* has a flat inclined surface 13*g* whose height decreases when approaching the insertion slot 13*a*. The area of the inclined surface 13*g* is preferably set to be larger than the opening area of the insertion slot 13*a*. The recessed portion 13*d* enables coins to be guided to the insertion slot 13*a* without a user having to correctly guide coins into the insertion slot 13*a*.

Insertion Sensors

Insertion sensors Si (not shown) are incorporated in the lid 13 and disposed so as to face the insertion slot 13*a*.

Wirings (not shown) such as electric wires and signal wires from a power supply (not shown) and a control device (not shown) are connected to the insertion sensors Si with most of the wirings contained in the lid 13.

An insertion sensors Si detects the presence or absence of a coin passing through the insertion slot 13*a*, and as examples, a transmission type or reflective optical sensor can be used. If a transmission type optical sensor is adopted as the insertion sensor Si, the light emitting unit and the light receiving unit of the optical sensor are provided facing the insertion slot 13*a* and are arranged so as to face each other.

Then, the light emitted from the light emitting unit of the optical sensor is received by the light receiving unit arranged so as to face the light emitting unit across the insertion slot 13*a*. When light is detected by the light receiving unit, there is no obstacle in the light path, and when light is not detected by the light receiving unit, there is an obstacle in the light path.

Therefore, the transmission type optical sensor is able to detect the presence or absence of an obstacle in the light path.

Note that the insertion sensors Si need not be optical sensors as long as they can detect the presence or absence of coins passing through the insertion slot 13*a*.

Preferably, a plurality of insertion sensors Si are provided for the insertion slot 13*a*. By providing a plurality of insertion sensors Si, even if the opening area of the insertion slot 13*a* is increased in order to increase the amount (loading speed) in which coins can be batch inserted, reliably detecting that a coin has passed the insertion slot 13*a* is possible.

If multiple insertion sensors Si are provided, the distance between each insertion sensor Si is preferably a distance which corresponds to at least the smallest size coin which is used. Thereby, when a coin (for example, a 1-yen coin) of the smallest dimension changes position and passes through the insertion slot 13*a*, the coin is able to be reliably detected.

Note that FIG. 2 shows the light L from the insertion slot 13*a* of the lid 13 and the insertion sensors Si when four insertion sensors Si are provided, but is not limited thereto. For example, a plurality of insertion sensors Si whose detection range is in the longitudinal direction with respect to the opening of the insertion slot 13*a* and a plurality of insertion sensors Si whose detection range is in the lateral direction can be respectively provided, and the path of light acting as the detection range may be appear to be a mesh in a plan view. In that case, in order to avoid the crossing of the light paths, each insertion sensor Si is arranged such that the vertical detection range and the horizontal detection range are shifted in the height direction.

Rotor

The rotor 20 is curved in a state where the upper surface is upwardly convex, and as a whole is substantially mountain-shaped.

The rotor 20 rotates in the forward direction clockwise about a rotating shaft which is rotated by power transmitted from a motor (not shown) supported by the cylindrical portion 10, is reversely rotated counterclockwise.

By configuring the rotor 20 in such a manner, coins dropped above the rotor 20 rotating in forward rotation are subjected to gravity and centrifugal force causing them to slide outward along the top of the rotor 20, carrying them into the passage R between the lower periphery of the rotor 20 and the side wall 11 and bottom wall 12 of the cylindrical portion 10, then while rolling within the passage R, transporting them with the forward rotation, and feeding them out from the coin outlet 12*a*.

Outer Periphery Sensors

Outer periphery sensors 30 detect the presence or absence of coins passing through the passage R at the outer peripheral portion of the rotor 20.

Outer periphery sensors 30 are incorporated in the side wall 11 or the bottom wall 12 of the cylindrical portion 10. Also, by having the main body portions of the outer periphery sensors 30 incorporated in the side wall 11 or the bottom wall 12, the light emitting units or the light receiving units of the outer periphery sensors 30 may be flush with the surface of the side wall 11 or the bottom wall 12. This prevents the conveyance of the coins from being impeded.

A plurality of outer periphery sensors 30 are arranged at intervals in the circumferential direction of the cylindrical portion 10. By arranging a plurality of outer periphery sensors 30, coin which are rolling around the passage R (see FIG. 3) on the outer periphery of the rotor 20 are able to be detected early on.

For example, transmission type or reflective optical sensors are examples of the outer periphery sensors 30 that can be used.

If transmission type optical sensors are used as the outer periphery sensors 30, the light emitting units and the light receiving units of the optical sensors are arranged to face the passage R and arranged so as to face each other.

Then, the light emitted from the light emitting unit of the optical sensor is received by the light receiving unit disposed so as to face the light emitting unit through the passage R. If light is detected by the light receiving unit, there is no obstacle such as a coin in the light path, and if light is not detected by the light receiving unit, an obstacle such as a coin is present in the light path.

Therefore, the transmission type optical sensor is able to detect the presence or absence of coins in the light path.

Note that the outer periphery sensors 30 need not be optical sensors as long as they can detect the presence or absence coins passing through the passage R. Alternatively, the light emitting unit may be provided on the bottom wall 12 and the light receiving unit may be provided on the side wall 11, or the light emitting unit is provided on the side wall 11 and the light receiving unit is provided on the bottom wall 12 so that the path of light emitted from the optical sensor is preferably oblique. As a result, the presence or absence of coins passing through the passage R are able to be detected, and coins stacked vertically can also be detected reliably.

The outer periphery sensors 30 preferably include at least a first outer periphery sensor 31, a second outer periphery sensor 32, and a third outer periphery sensor 33. As a result, inserted coins circulating in the passage R are able to be detected early on.

The first outer periphery sensor 31 is disposed at a position farthest from the coin outlet 12*a* in the normal rotation direction. The second outer periphery sensor 32 is disposed at a position closer to the coin outlet 12*a* than the first outer periphery sensor 31 in the normal rotation direction. The third outer periphery sensor 33 is disposed in the vicinity of the coin outlet 12*a*. The first outer periphery sensor 31 and the second outer periphery sensor 32 are disposed at substantially opposite positions inside the cylindrical portion 10. By arranging the first outer periphery sensor 31, the second outer periphery sensor 32, and the third outer periphery sensor 33 in this way, inserted coins circulating in the passage R are able to be detected early on, and the positions of the inserted coins up to the coin outlet 12*a* are able to be detected.

FIG. 3 shows detection ranges L1, L2 and L3 of the first outer periphery sensor 31, the second outer periphery sensor 32, and the third outer periphery sensor 33, respectively. As described above, by providing three detection ranges (detection positions), coins rolling in the passage R (see FIG. 3) around the outer peripheral portion of the rotor 20 are able to be detected earlier.

Diameter Sensor

The diameter sensor 50 detects coins located above the rotor 20.

Transmission type or reflective optical sensors are examples of the diameter sensor 50 that may be used.

If a transmission type optical sensor is adopted as the diameter sensor 50, the light emitting unit and the light receiving unit of the optical sensor are provided in the side wall 11 of the cylindrical portion 10 and disposed so as to face each other, and the light emitted from the light emitting unit is able to be received by the light receiving unit. Then, as shown in FIG. 3, the light path from the light emitting part to the light receiving unit which becomes the detection range d of the diameter sensor 50 is arranged so as to be horizontal slightly above the rotor 20. As a result, because the light from the light emitting unit to the light receiving unit is blocked coins protruding above the rotor 20, and since inserted coins are accumulated inside the cylindrical portion 10 and as the coins overlap, coins stacked up to the upper side of the rotor 20 or the like are able to be detected.

Control Device

The control device 40 (not shown) is housed, for example, in a housing provided at the bottom of the rotor 20 and at the bottom of the bottom wall 12.

The control device 40 outputs signals for controlling the rotational speed of the motor to the motor driver 60 based on the detection signal from each sensor. Specifically, the control device 40 drives the motor by PWM control, and controls the rotational speed by changing the pulse duty ratio.

Figure 4:
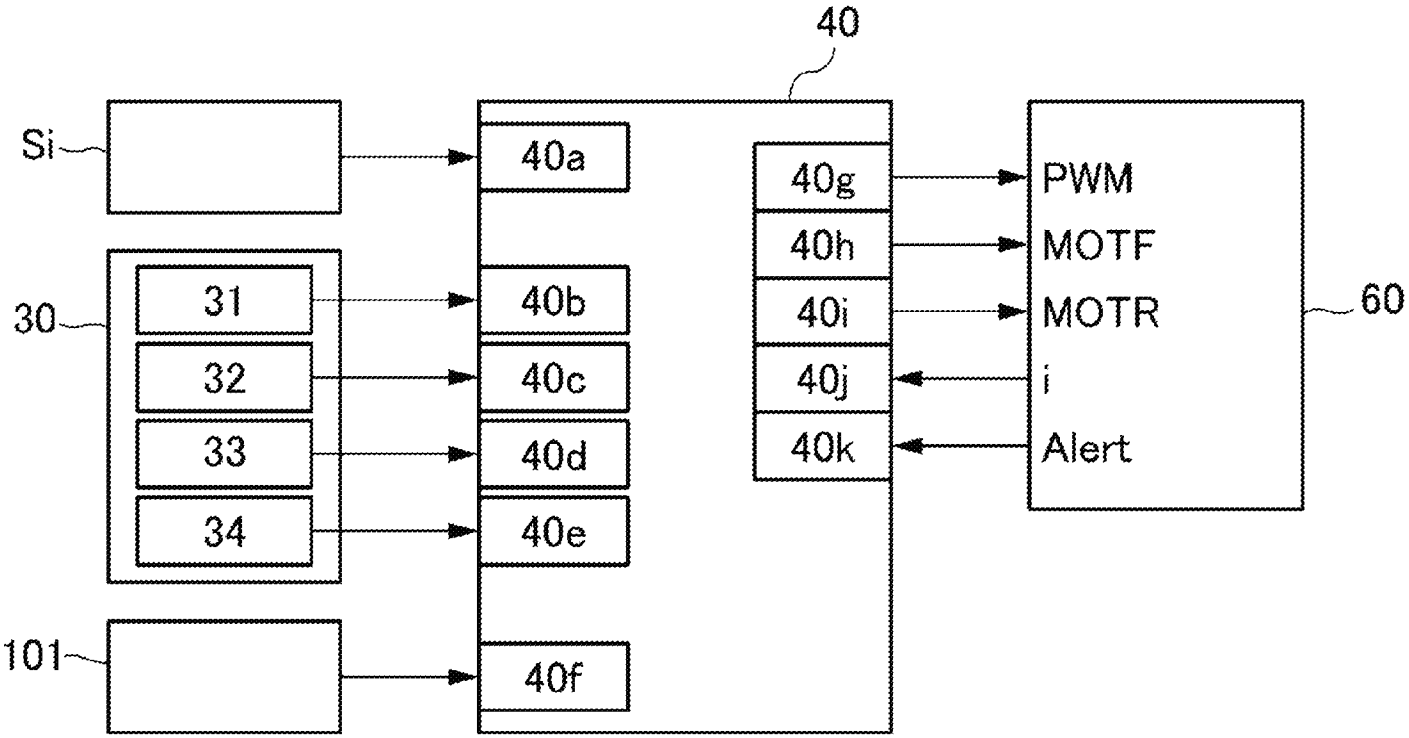
FIG. 4 is a conceptual diagram showing transmission relationships of signals of a control device, a motor driver for driving a motor for rotating a rotor, and each sensor.

FIG. 4 is a conceptual diagram showing transmission relationships of signals between the control device 40, a motor driver 60 for driving a motor that rotates the rotor 20, and each sensor.

As shown in FIG. 4, the control device 40 is electrically connected to the motor driver 60 and each sensor via signal lines.

Signals from the insertion sensors Si are input into ADC (analog-digital converter) 40*a* of the control device 40. Similarly, signals from the first outer periphery sensor 31, the second outer periphery sensor 32, the third outer periphery sensor 33, and the diameter sensor 50 are input into ADCs 40*b*, 40*c*, 40*d*, and 40*e*, respectively, of the control device 40. Similarly, signals from the optical sensor and the magnetic sensor 101 built into the sorting unit 100 are input into ADC 40*f* of the control device 40.

The PWM control signal (rotational speed command) from the timer 40*g* built into the control device 40 is input into the motor driver 60. Command signals for forward rotation and reverse rotation from port 40*h* of the Control device 40 and port 40*i* are input into the motor driver 60. The motor current signal from the motor driver 60 is input into ADC 40*j* of the control device 40. The alert signal from the motor driver 60 is input to port 40*k* of the control device 40.

Rotor Control Flow

Next, the flow of the control of the rotor performed by the control device 40 will be described with reference to FIGS. 5 to 11.

Figure 5:
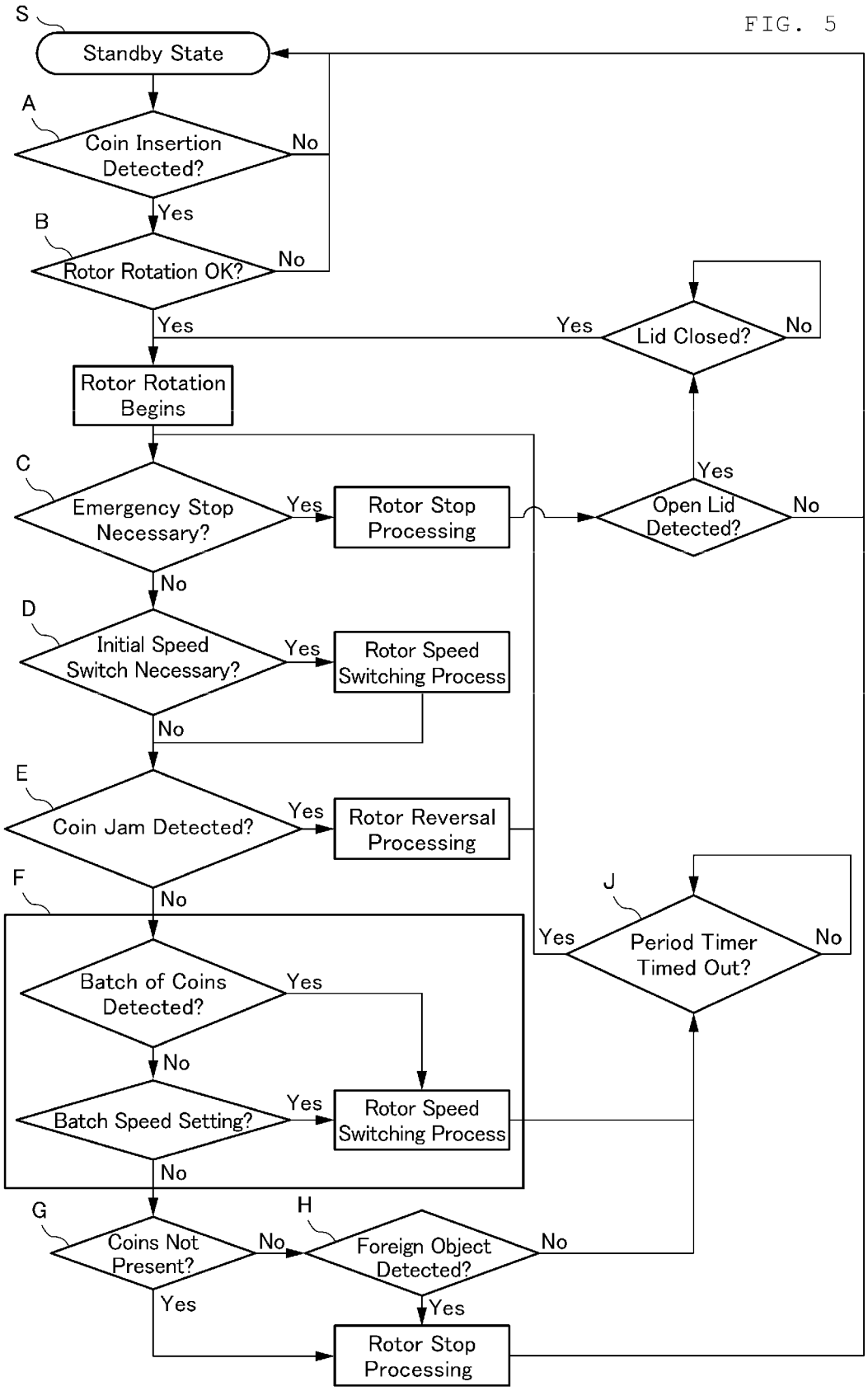
FIG. 5 is a control flow diagram of the entire rotor control.
Figure 6:
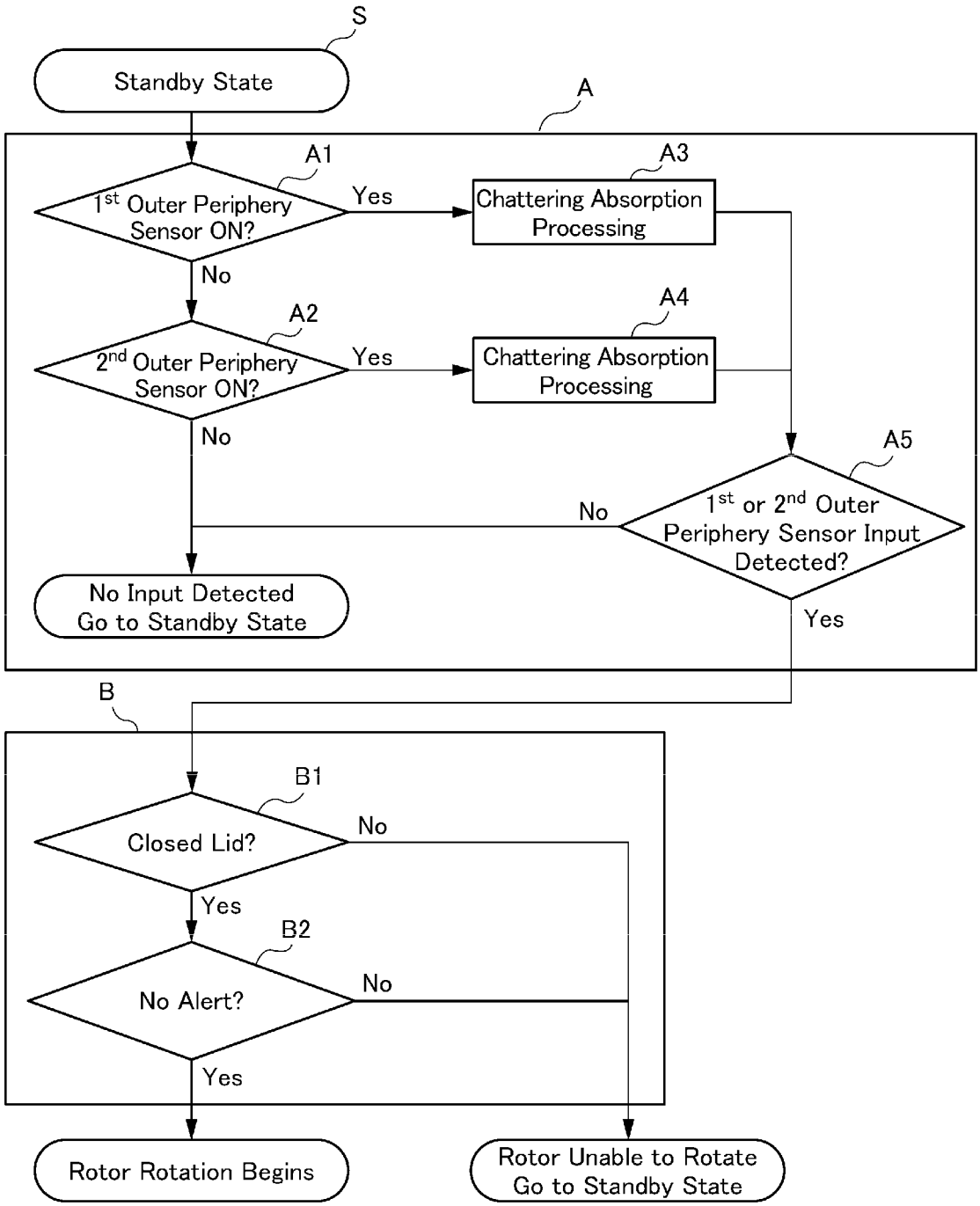
FIG. 6 is a control flow diagram showing the processing details in a coin insertion determination unit and a rotor rotation feasibility determination unit.
Figure 7:
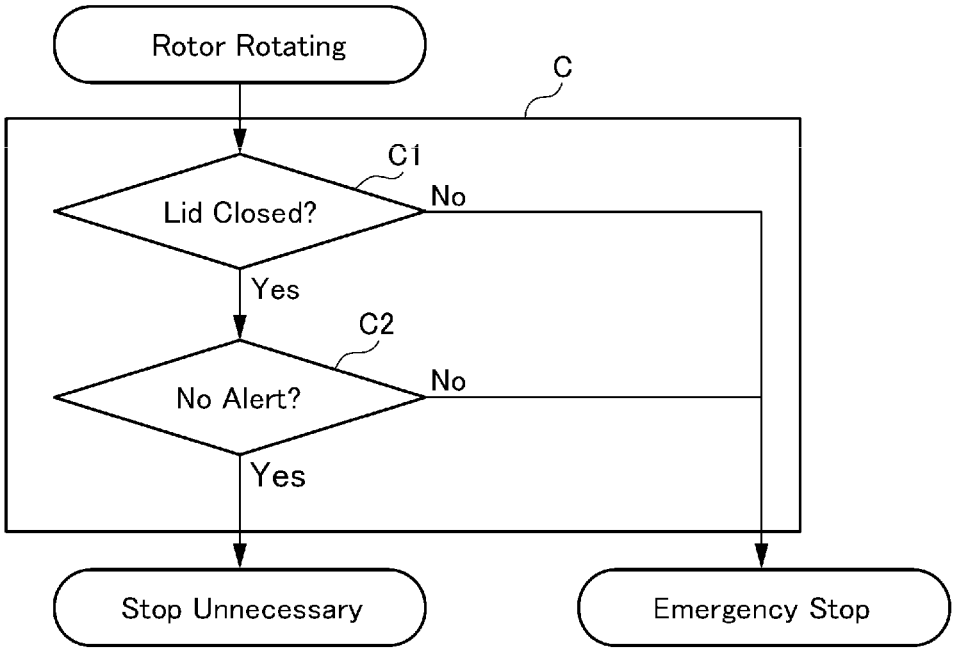
FIG. 7 is a control flow diagram showing processing details in an emergency stop determination unit.
Figure 8:
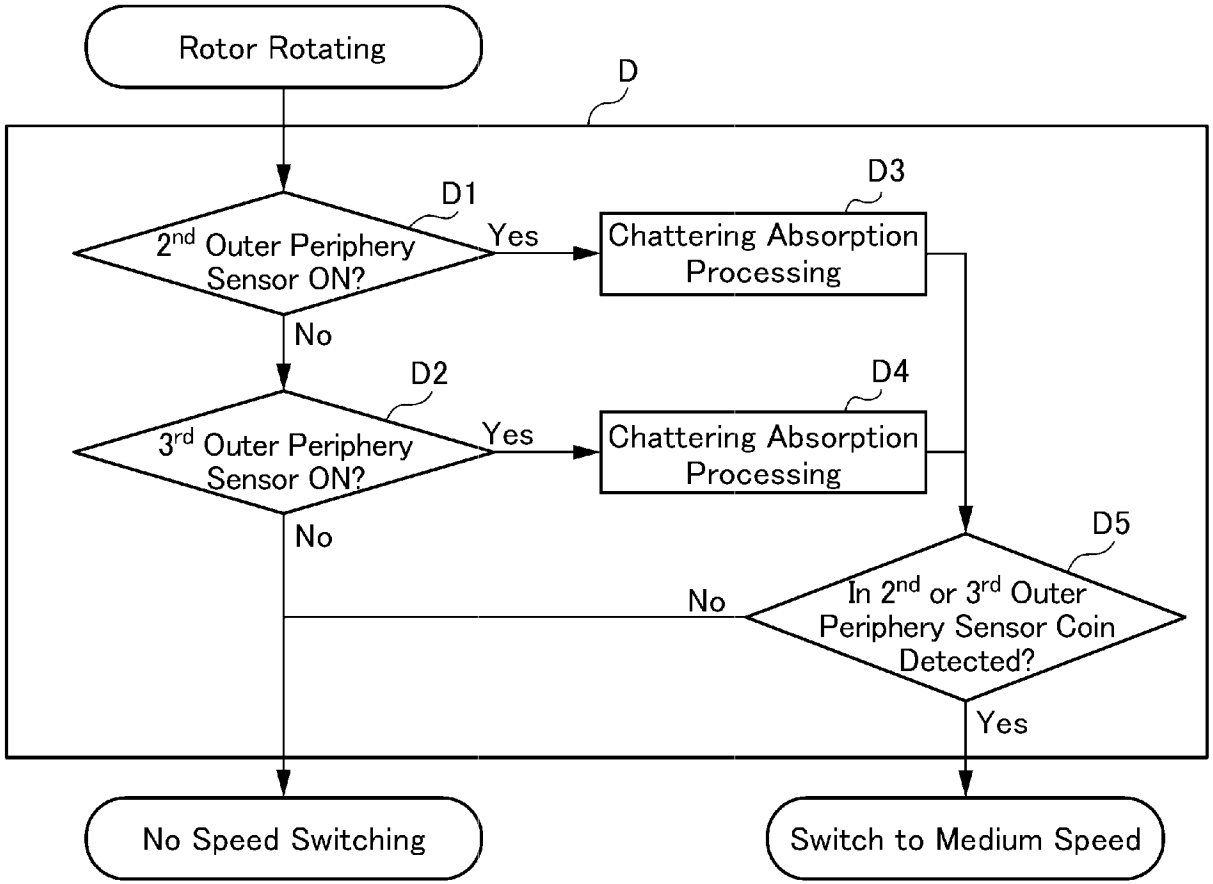
FIG. 8 is a control flow diagram showing processing details in the initial speed switching determination unit.
Figure 9:
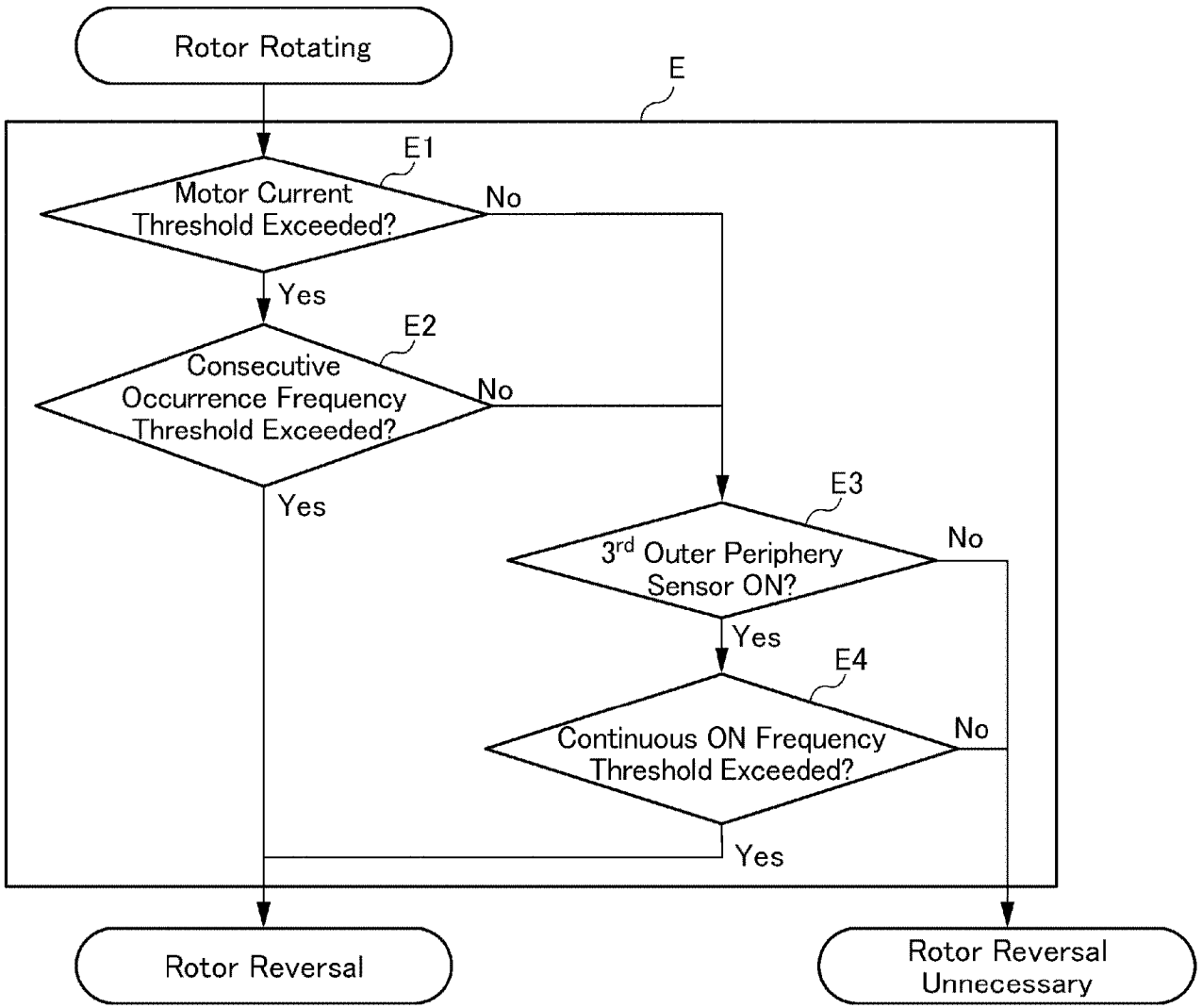
FIG. 9 is a control flow chart showing processing details in a coin jam determination unit of a first embodiment.
Figure 10:
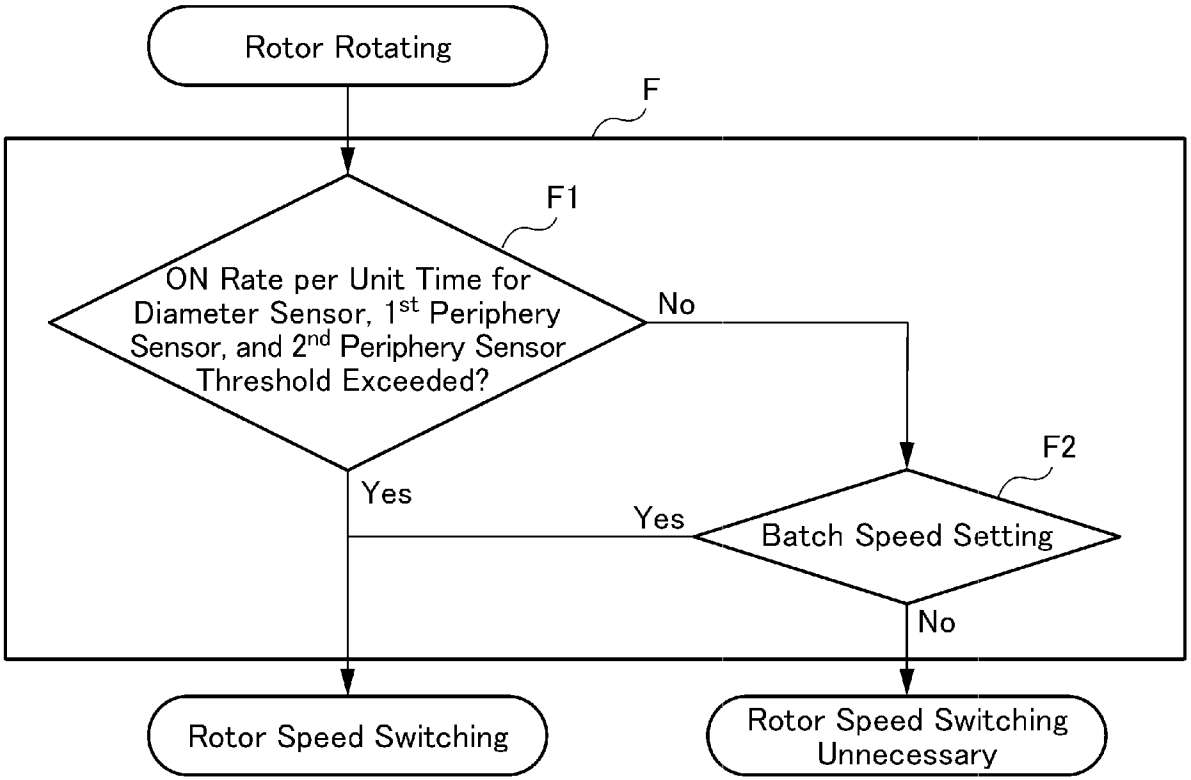
FIG. 10 is a control flow diagram showing processing details in a batch coin determination unit.
Figure 11:
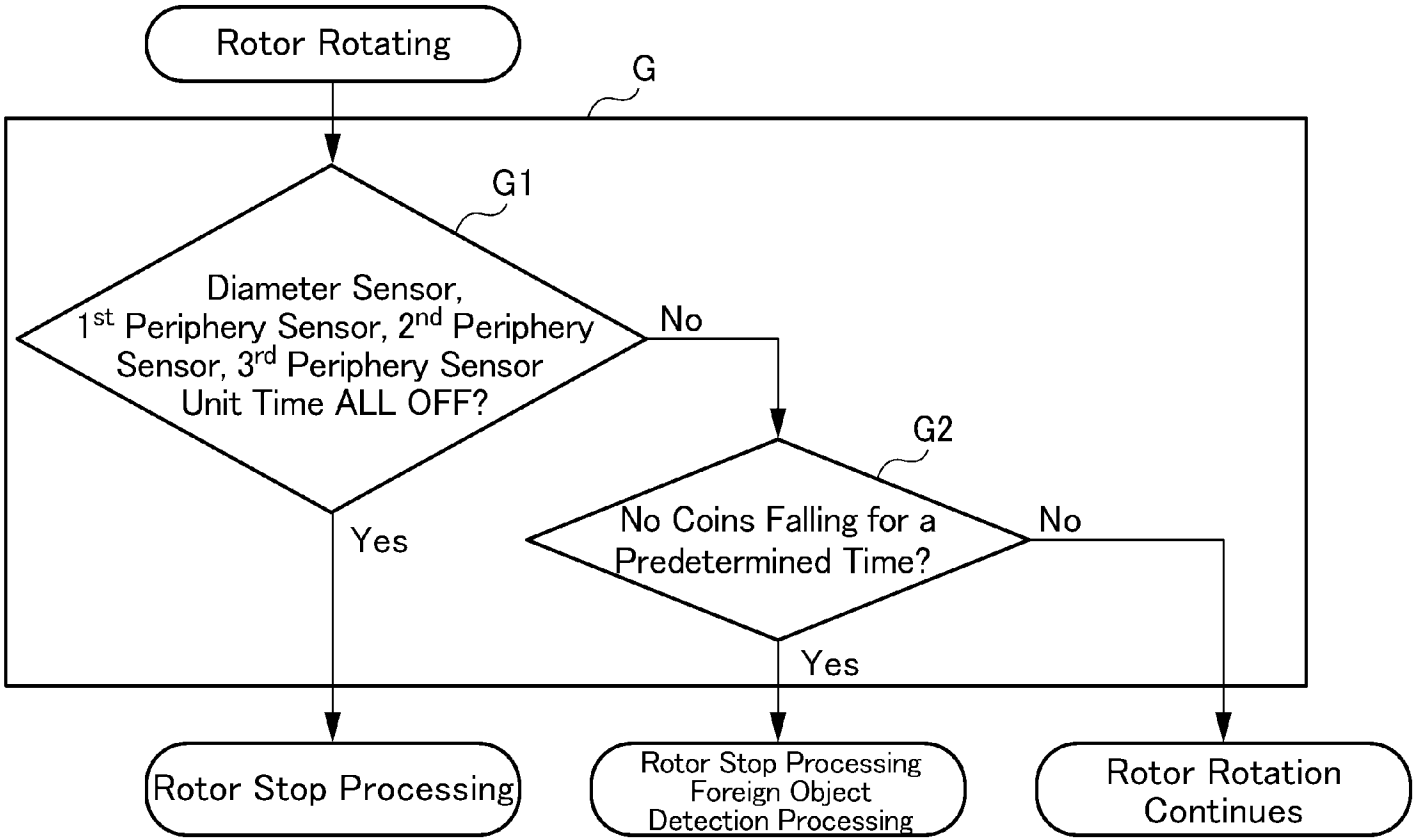
FIG. 11 is a control flow diagram showing processing details in a coin-less determination unit.

FIG. 5 is a control flow diagram of the entire rotor control. FIG. 6 is a control flow diagram showing the processing details of a coin insertion determination unit A and a rotor rotation feasibility determination unit B. FIG. 7 is a control flow diagram showing processing details in an emergency stop determination unit C. FIG. 8 is a control flow diagram showing processing details in an initial speed switching determination unit D. FIG. 9 is a control flow diagram showing processing details in a coin jam determination unit E according to the first embodiment. FIG. 10 is a control flow diagram showing processing details in a batch coin determination unit F. FIG. 11 is a control flow diagram showing processing details in a coin-less determination unit G.

Note that in the following, although a case where optical sensors adopted as the insertion sensors Si with two optical sensors, a first insertion sensor Si1 and a second insertion sensor Si2, being used; optical sensors adopted as the outer periphery sensors 30 with three optical sensors, a first outer periphery sensor 31, a second outer periphery sensor 32, and a third outer periphery sensor 33, being used; and an optical sensor adopted as the diameter sensor 50 will be described, the number of sensors may be changed according to the dimensions such as with the opening 14*a* and the cylindrical portion 10 as well as according to the required detection accuracy.

Coin Insertion Determination Unit and Rotor Rotation Feasibility Determination Unit As shown in FIG. 5, the control device 40 is in a standby state S with the rotor 20 stationary. When the coin insertion determination unit A determines that a coin has been inserted, a transition to the rotor rotation feasibility determination unit B is made, but if a coin is not inserted, the standby state S is maintained.

Specifically, as shown in FIG. 6, when an ON signal from the first insertion sensor Si1 or the second insertion sensor Si2 is received in determination unit A1 or determination unit A2 (when the determination result of A1 or A2 is Yes), chattering absorption processing unit A3 or A4 performs a chattering absorption processing, then in the determination unit A5, if there is an ON signal from at least one of the first insertion sensor Si1 and the second insertion sensor Si2, coin insertion determination unit A determines that a coin has been inserted. Then, if the coin insertion determination unit A determines that a coin has been inserted (when the determination result of A5 is Yes), a transition to the rotor rotation feasibility determination unit B is made.

Even if coin insertion determination unit A determines that a coin has been inserted, Rotor rotation feasibility determination unit B, if the determination unit B1 determines that the lid 13 is open (when the determination result of B1 is No), or if the determination unit B2 determines a state in which an alert signal indicating an abnormal state is input from the motor driver 60 (when the determination result of B2 is No), then the rotor rotation feasibility determination unit B maintains the standby state S without rotating the rotor 20. However, if the lid 13 is in a closed state and an alert signal indicating an abnormal state is not input from motor driver 60, a command signal for causing the rotor 20 to rotate forward is output to the motor driver 60, and a transition to the emergency stop determination unit C is made.

If the motor driver 60 receives a command signal for rotating the rotor 20 in the forward direction, the motor driver 60 rotates the rotor 20 at a high speed Vh. The high speed Vh is, for example, 90% rotation speed (for example, about 3 rotations per second) when the maximum value of the rotation speed obtained from the motor output is 100%. By setting the rotational speed of the rotor to the high speed Vh immediately after determining that a coin has been inserted, the time for conveying the coin to the coin outlet 12*a* can be shortened as much as possible.

Emergency Stop Determination Unit

As shown in FIG. 5, if the emergency stop determination unit C determines that an emergency stop is necessary while the rotor 20 is rotating, a command signal for stopping the rotation of the rotor 20 is output to the motor driver 60, otherwise a transition to the initial speed switching determination unit D is made.

More specifically, as shown in FIG. 7, even after the rotor 20 starts rotating on account of the rotor rotation feasibility determination unit B, if the determination unit C1 determines that the lid 13 is open (if the determination result of C1 is No), or if the determination unit C2 determines a state in which an alert signal indicating an abnormal state is input from the motor driver 60 (when the determination result of C2 is No), then the emergency stop determination unit C outputs to the motor driver 60 a command signal for an emergency stop of the rotation of the rotor 20.

Also, if the determination unit C1 determines that the lid 13 is closed (if the determination result of C1 is Yes), and if the determination unit C2 determines that the motor driver 60 does not receive an alert signal indicating an abnormal condition (when the determination result of C2 is Yes), then forward rotation of the rotor 20 is maintained.

Initial Speed Switching Determination Unit

As shown in FIG. 5, when the initial speed switching determination unit D determines that a coin is approaching or has reached the coin outlet 12*a*, a command signal for setting the rotational speed of the rotor 20 to a medium speed Vm is output to the motor driver 60, and a transition to the coin jam determination unit E is made.

Specifically, as shown in FIG. 8, if an ON signal from the second outer periphery sensor 32 or the third outer periphery sensor 33 is received in determination unit D1 or determination unit D2 (if the determination result of D1 or D2 is Yes), then chattering absorption processing unit D3 or D4 performs a chattering absorption processing, then in the determination unit D5, if there is an ON signal from at least one of the second outer periphery sensor 32 and the third outer periphery sensor 33, the initial speed switching determination unit D determines that a coin is approaching or has reached the coin outlet 12*a*.

Then, if the initial speed switching determination unit D determines that the coin is approaching or has reached the coin outlet 12*a* (when the determination result of D5 is Yes), a command signal for switching the rotational speed of the rotor 20 to a medium speed Vm is output to the motor driver 60.

If the motor driver 60 receives a command signal to switch the rotational speed of the rotor 20 to a medium speed Vm, the rotor 20 is rotated at the medium speed Vm. The medium speed Vm is a rotational speed lower than the high speed Vh, and is, for example, 70% of the rotational speed when the maximum value of the rotational speed obtained from the motor output is 100%.

Because if the rotational speed of the rotor 20 is too high, coins falling from the coin outlet 12*a* is difficult, and if it is too slow, the coins take time to reach the coin outlet 12*a*, so by setting the rotational speed of the rotor 20 as medium speed Vm after the coin is approaching or has reached the coin outlet 12*a*, which is not too a high speed and not too low a speed, a coin can be efficiently and reliably dropped from the coin outlet 12*a*.

First Coin Jam Determination Unit

As shown in FIG. 5, if the coin jam determination unit E determines there is a coin jam, the rotor 20 is reversely rotated for a predetermined time, and then a command signal for returning to the forward rotation is outputted to the motor driver 60, and a transition to the batch coin determination unit F is made.

Specifically, as shown in FIG. 9, if the motor current i of the motor that drives the rotor 20 is determined to have exceeded a threshold (when the determination result of E1 is Yes), and if the number of consecutive occurrences (or time) is determined to have exceeded a threshold (if the determination result of E2 is Yes), then the coin jam determination unit E rotates the rotor 20 reversely for a predetermined time, and thereafter, a command signal for returning to forward rotation is output to the motor driver 60.

Moreover, if the motor current i is determined to not have exceeded the threshold (when the determination result of E1 is No), or if the number of consecutive occurrences (or time) is determined not to have exceeded the threshold (when the determination result of E2 is No), then in the determination unit E3 the coin jam determination unit E determines whether or not an ON signal is input from the third outer periphery sensor 33.

If an ON signal is input from the third outer periphery sensor 33 (when the determination result of E3 is Yes), the process proceeds to determination unit E4, but if an ON signal is not input from the third outer periphery sensor 33 (when the determination result of E3 is No), the rotation of the rotor 20 is maintained, and a transition to the batch coin determination unit F is made.

If the determination unit E4 determines that the number of consecutive ONs corresponding to the time when the third outer periphery sensor 33 continuously detects coins exceeds a threshold (when the result of the E4 determination is Yes), the rotor 20 is reversely rotated for a predetermined time, and thereafter, a command signal for returning to forward rotation is output to the motor driver 60.

When the motor driver 60 receives a command signal to reversely rotate the rotor 20, the motor driver 60 reversely rotates the rotor 20. The rotational speed of reverse rotation is equal to the high speed Vh of the rotational speed of forward rotation, and is, for example, 90% of the rotational speed when the maximum value of the rotational speed obtained from the motor output is 100%. By setting the rotational speed of the reverse rotation to the high speed Vh, the reverse rotation can be performed with a stronger force than that of the forward rotation at the medium speed Vm, and the coin jam can be eliminated.

Because the coin jam is determined using not only the motor current i but also the detection results from the third outer periphery sensor 33 of coins in the vicinity of the coin outlet 12*a*, even if the rotor 20 is rotating without locking up while a coin jam is occurring, a coin jam can be correctly detected.

Note that the coin jam determination unit E is not limited to the third outer periphery sensor 33, and a coin jam may be determined when the time in which coins are continuously detected exceeds a threshold value in any of the plurality of outer periphery sensors 30.

Also, in the coin jam determination unit E, if in any one of the plurality of outer periphery sensors 30, the time when coins are continuously detected exceeds a threshold value, or if the motor current i for driving the rotor 20 exceeds a threshold value, a coin jam is determined, and if a coin jam is determined, then the control device 40 may control so as to reversely rotate the rotor 20 for a predetermined time and then to return to forward rotation.

Batch Coin Determination Unit

As shown in FIG. 5, if a large amount of coins are determined to have stayed inside the cylindrical portion 10, the batch coin determination unit F outputs a command signal for setting the rotational speed of the rotor 20 to a low speed V1 to the motor driver 60. In addition, without a large number being present, a large number of coins will not be detected, and if the rotational speed of the rotor 20 is the low speed V1, a command signal for setting the rotational speed of the rotor 20 to the medium speed Vm is output to the motor driver 60. Otherwise, a transition to the coin-less determination unit G is made.

More specifically, as shown in FIG. 10, if the batch coin determination unit F determines that the ON ratio per unit time of the diameter sensor 50, the first outer periphery sensor 31, and the second outer periphery sensor 32 exceeds a threshold (if the determination result of F1 is Yes), a command signal for setting the rotational speed of the rotor 20 to the low speed V1 is output to the motor driver 60.

Specifically, in each of the diameter sensor 50, the first outer periphery sensor 31, and the second outer periphery sensor 32, if the ratio r (r=n/N) in which the number of times n the three sensors simultaneously detected a coin within a predetermined time b (b>>p) (for example, 1 second), with respect to the total number of times N of detection of the presence or absence of a coin simultaneously at a predetermined period p within the predetermined time b is equal to or more than a threshold T (for example, 90%), then the determination unit F1 determines that the amount of coins present inside the cylindrical portion 10 is large.

Note that if the ratio r is 90% or more, a large amount of coins is determined as being present, and if the ratio r is 70% or more and less than 90%, a somewhat large amount of coins is determined as being present. Also, for example, if a large amount of coins is determined to be present, the rotational speed of the rotor 20 is set to 60% of the maximum value of the rotational speed obtained from the motor output as 100%, and if a somewhat large amount of coins is determined to be present, the rotational speed of the rotor 20 may be 50%. Thus, because the rotational speed of the rotor 20 is able to be changed based on the amount of coins so that the rotational speed decreases as the amount of coins increases, the delivery efficiency of the coins increases.

If a large amount of coins are not determined to be present (when the determination result of F1 is No), and if the rotational speed of the rotor 20 is the low speed V1 (if the determination result of the determination unit F2 is Yes), then determination unit F2 outputs a command signal for returning the rotational speed of the rotor 20 to the medium speed Vm to the motor driver 60. But if the rotation speed of the rotor 20 is not the low speed V1 (if the determination result of the determination unit F2 is No), the determination unit F2 maintains the rotation speed of the rotor 20, and a transition to the coin-less determination unit G is made.

Coin-Less Determination Unit

As shown in FIG. 5, if the coin-less determination unit G determines that no coins are inside the cylindrical portion 10 for a predetermined time, a command signal for stopping the rotation of the rotor 20 is output to the motor driver 60. Then, the control device 40 enters the standby state S again. Otherwise, a determination is made that the coins are not falling for a predetermined time. If a determination is made that coins are not falling for a predetermined time, a command signal for stopping the rotation of the rotor 20 is output to the motor driver 60, and foreign object detection information is output to, for example, a display unit or an alarm unit. Otherwise, rotation of the rotor 20 continues.

More specifically, as shown in FIG. 11, if the determination unit G1 determines that the ON signal is not input at all within a predetermined time from all the sensors of the diameter sensor 50, the first outer periphery sensor 31, the second outer periphery sensor 32 and the third outer periphery sensor 33 (when the determination result of G1 is Yes), the coin-less determination unit G outputs a command signal for stopping the rotation of the rotor 20 to the motor driver 60. When the motor driver 60 receives a command signal for stopping the rotation of the rotor 20, the motor driver 60 stops the rotation of the rotor 20.

If the determination unit G1 receives an ON signal from any of the diameter sensor 50, the first outer periphery sensor 31, the second outer periphery sensor 32, and the third outer periphery sensor 33 (when the determination result of G1 is No), a transition to determination unit G2 is made.

Even if, for example, a predetermined time has passed since the latest ON signal from insertion sensors Si was input due to a coin not falling for a predetermined time, if the determination unit G1 receives an ON signal from any of the diameter sensor 50, the first outer periphery sensor 31, the second outer periphery sensor 32, and the third outer periphery sensor 33 (when the determination result of G2 is Yes), determination unit G2 transitions to the foreign object determination unit H. Otherwise (when the determination result of G2 is No), the rotation of the rotor 20 is maintained.

The coin-less determination unit G is able to reduce the time for rotating the rotor 20 in the absence of coins in the cylindrical portion 10, thereby saving power.

Foreign Object Determination Unit

As shown in FIG. 5, if a rush of coins from the coin outlet 12*a* into the sorting unit 100 is not able to be detected by discharge sensors or the like (not shown) provided in the coin outlet 12*a* despite the coins having been in the cylindrical portion 10 for a predetermined time, the foreign object determination unit H determines that a foreign object has been input into the cylindrical portion 10 (if the determination result of the foreign object determination unit H is Yes), and a command signal for stopping the rotation of the rotor 20 is output to the motor driver 60. Otherwise (if the determination result of the foreign object determination unit H is No), rotation of the rotor is maintained. Then, in a period timer determination unit J, every time the period timer times out, a transition to the emergency stop determination unit C is made.

Note that the coin jam determination unit E may determine a coin jam occurred, and at the same time the batch coin determination unit F may determine that a large number of coins are present. Alternatively, the coin jam determination unit E may determine that a coin jam is occurring and while the rotor 20 is rotating at a low speed V1, the batch coin determination unit F determines that a large amount of coins are remaining. Furthermore, the coin jam determination unit E determines the occurrence of a coin jam, and the rotor 20 is reversely rotated for a predetermined time, and thereafter, during the return to forward rotation, a coin jam may be determined by the batch coin determination unit F. In these cases, control priority is given to the coin jam determination unit E over the batch coin determination unit F. Thereby, the rotation of the rotor 20 is able to be controlled without controls interfering with each other, and coin jams are able to be eliminated and the delivery efficiency is able to be kept high even if the number of coins is large.

Operation

Hereinafter, an outline of the operation of the coin batch loading device 1 will be described focusing on the movement of the coin and the rotation operation of the rotor 20 with reference to FIGS. 1-3 and 12-17.

Figure 12:
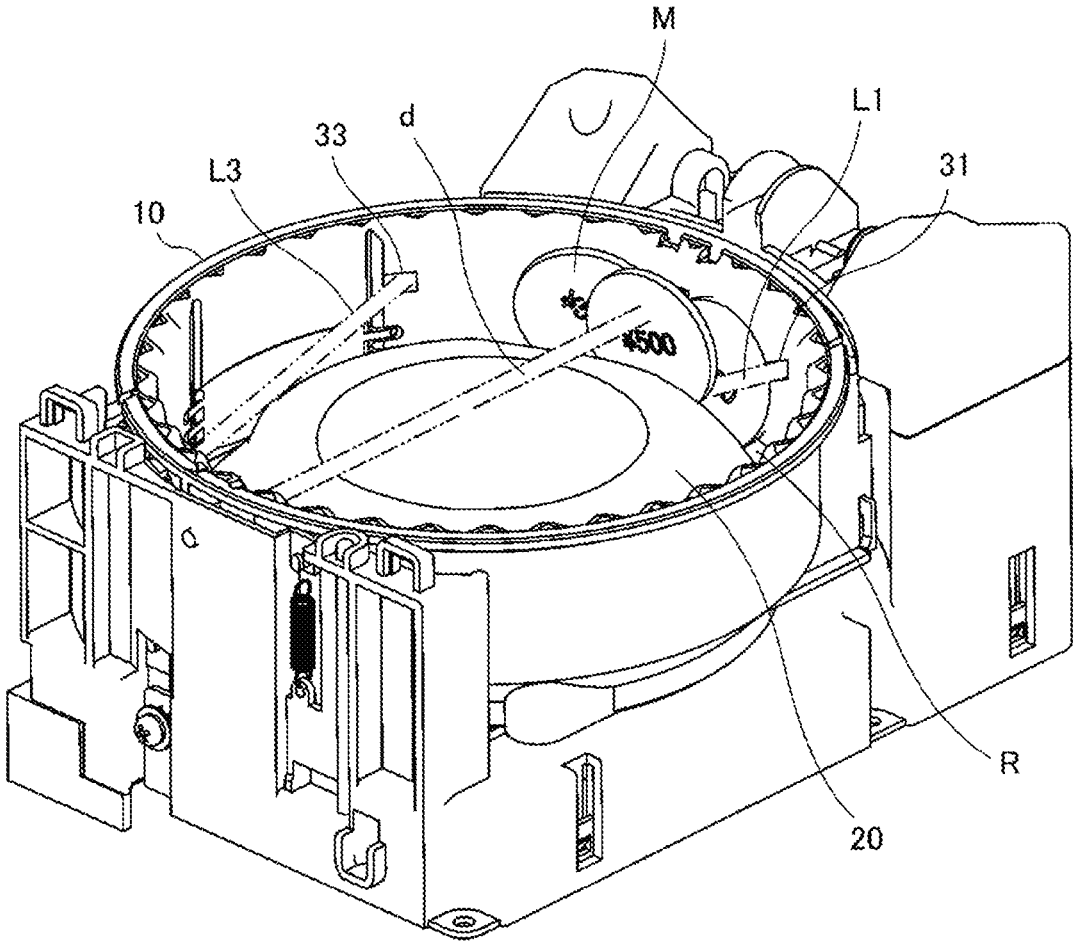
FIG. 12 is a view showing a state in which the coin is in the detection range of a first outer periphery sensor and the first outer periphery sensor detects that the coin is in the detection range.

FIG. 12 is a diagram showing a state in which a coin M is in the detection range L1 of the first outer periphery sensor 31, and the first outer periphery sensor 31 detects that the coin M is in the detection range L1.

Figure 13:
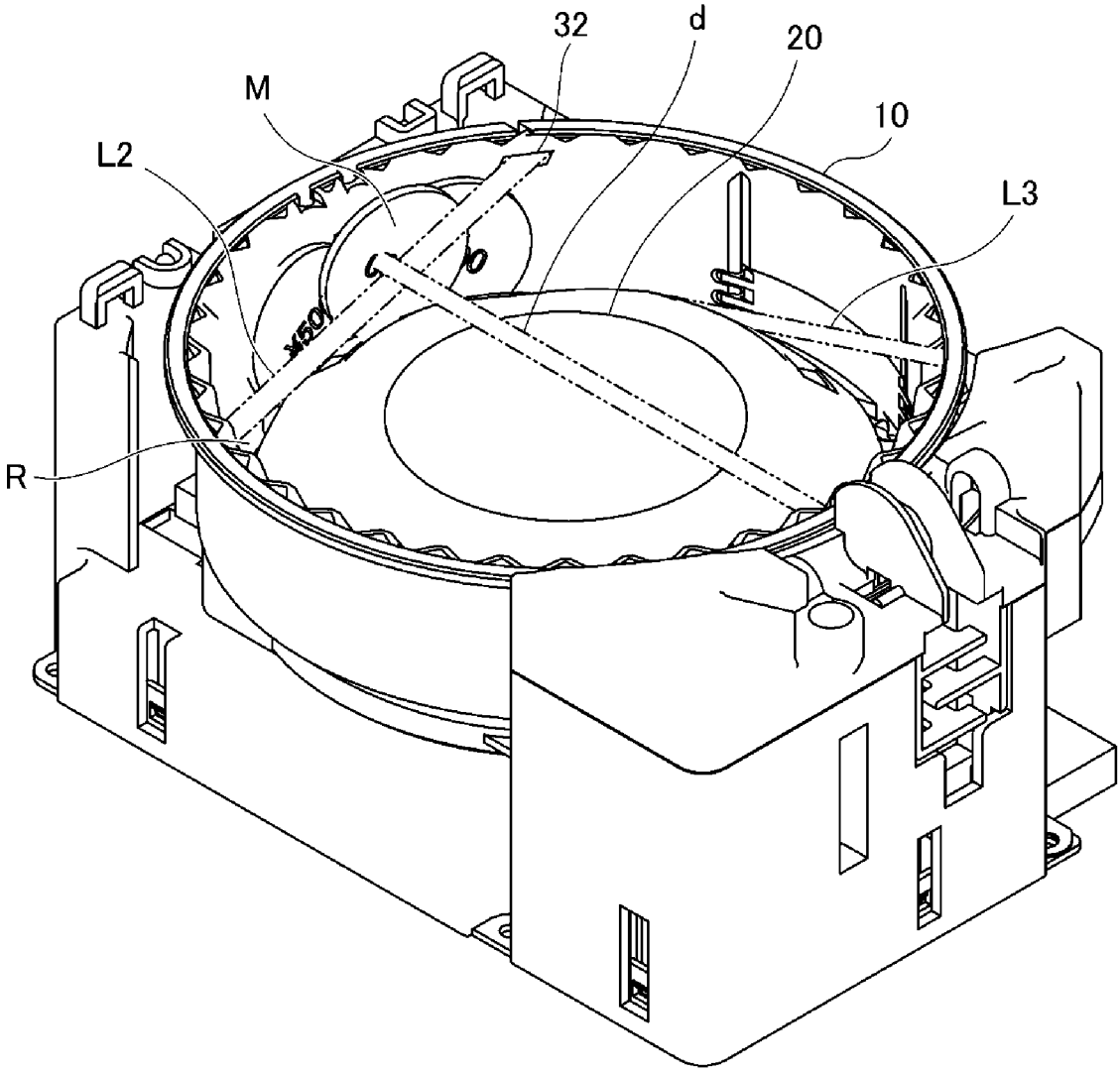
FIG. 13 is a view showing a state in which the coin is in the detection range of a second outer periphery sensor and the second outer periphery sensor detects that the coin is in the detection range.

FIG. 13 is a diagram showing a state in which the coin M is in the detection range L2 of the second outer periphery sensor 32, and the second outer periphery sensor 32 detects that the coin M is in the detection range L2.

Figure 14:
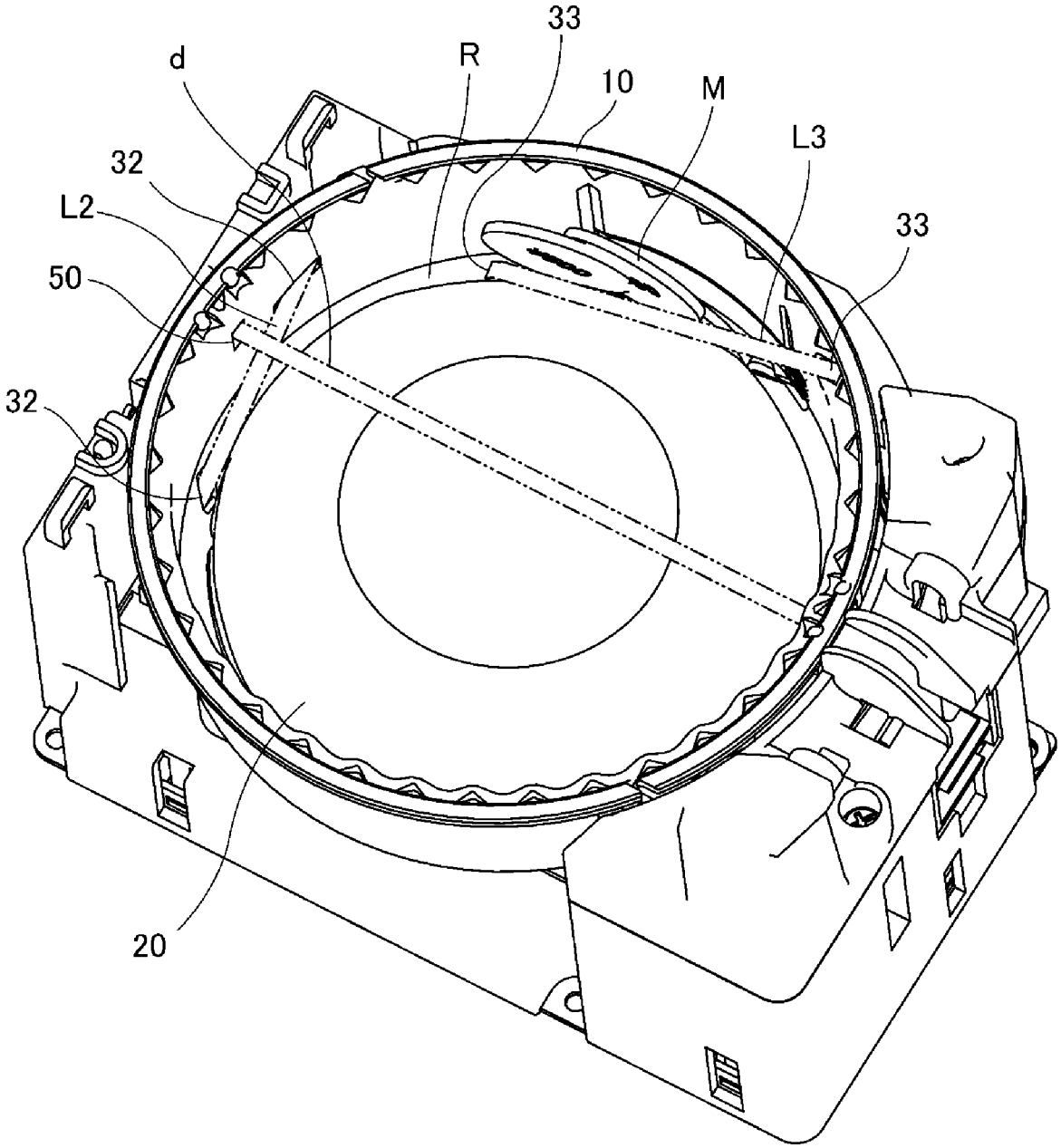
FIG. 14 is a view showing a state in which the coin is in the detection range of a third outer periphery sensor and the third outer periphery sensor detects that the coin is in the detection range.

FIG. 14 is a diagram showing a state in which the coin M is in the detection range L3 of the third outer periphery sensor 33, and the third outer periphery sensor 33 detects that the coin M is in the detection range L3.

Figure 15:
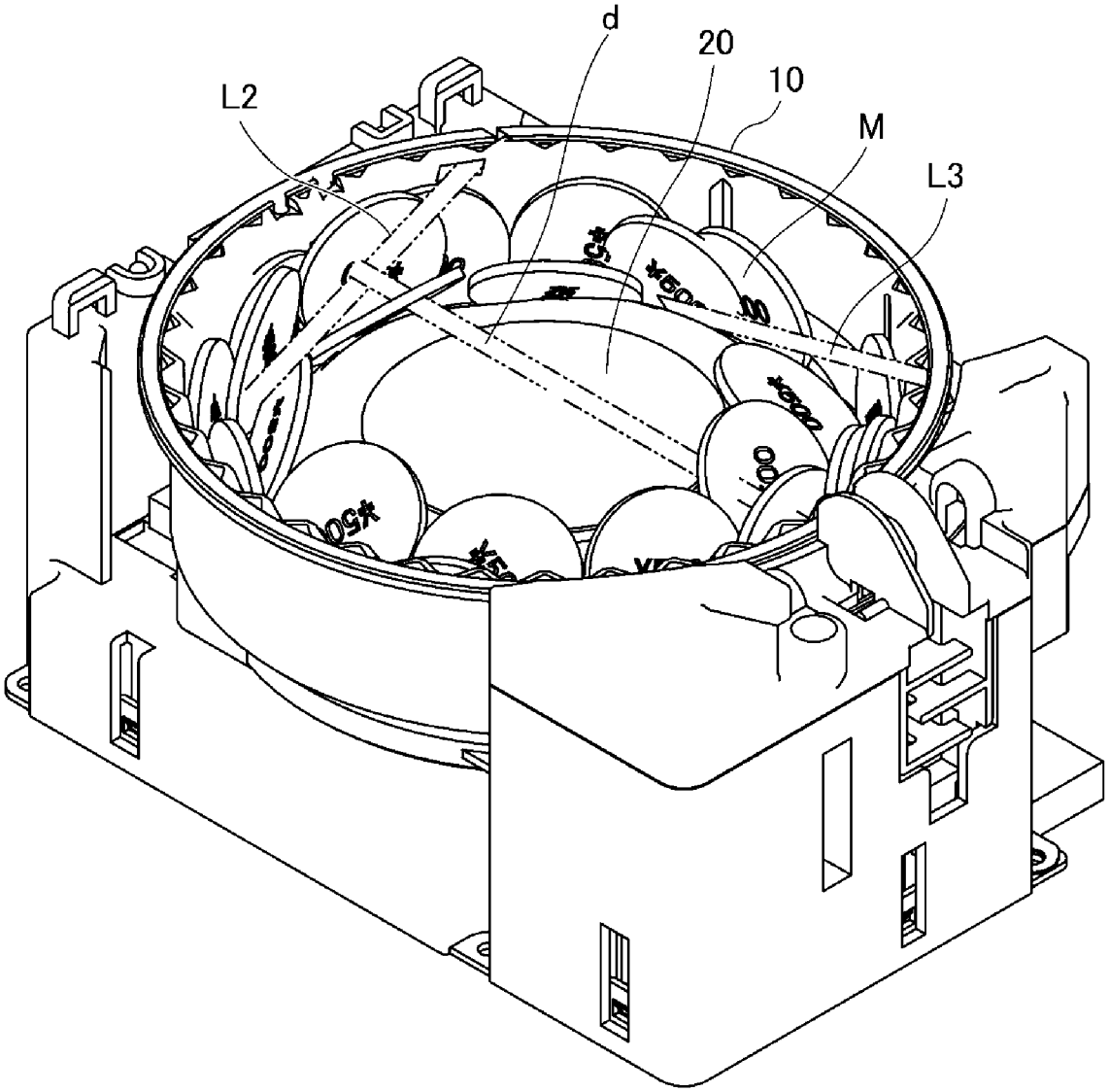
FIG. 15 is a perspective view of a coin batch loading device with a lid omitted, in which a batch of coins have been loaded.
Figure 16:
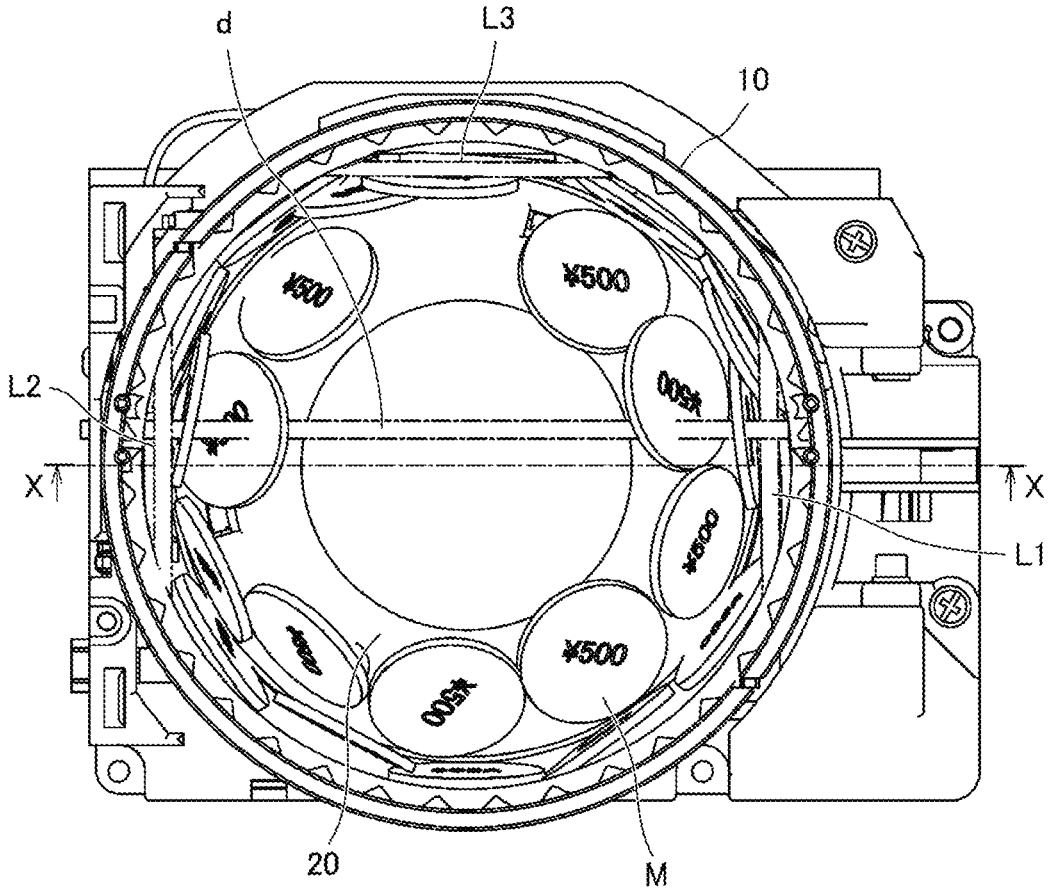
FIG. 16 is a plan view of FIG. 15.

FIG. 15 is a perspective view of the coin batch loading device 1 with the lid 13 omitted, in which a large amount of coins M have been loaded; FIG. 16 is a plan view of FIG. 15; and FIG. 17 is a cross-sectional view taken along arrow view X of FIG. 16.

Note that FIG. 12, FIG. 13, and FIG. 14 are perspective views when looking obliquely downward from above, and the viewing directions are different from each other. The lid 13 is omitted in FIG. 12, FIG. 13, and FIG. 14.

First, start by acting under the assumption that the coin batch loading device 1 is in a standby state S (see FIG. 1 and FIG. 2) with the lid 13 closed and the rotor 20 not rotating.

(1) When a user inserts a plurality of coins M having different outer diameters, plate thicknesses and materials (for example, 500 yen coins, 100 yen coins, 50 yen coins, etc.) into the insertion slot 13*a*, the insertion sensors Si detect the insertion of the coins M.

Here, when the insertion sensors Si detect the insertion of the coins M, the control device 40 rotates the rotor 20 in the forward direction and sets the rotation speed to the high speed Vh until the outer periphery sensor 30 detects the coins M.

(2) The coins M pass through insertion slot 13*a*, proceed from the top of the rotor 20 reaching the outer periphery of the rotor 20 where under a frictional force from the rotor 20, they move into the passage R and are moved along the rotational direction (clockwise) of the rotor 20. FIG. 12 shows an example in a coin M that has reached the detection range L1 of the first outer periphery sensor 31 moves in a clockwise direction along the rotational direction of the rotor 20; FIG. 13 discloses when the detection range L2 of the second outer periphery sensor 32 has been reached, and FIG. 14 discloses when the detection range L3 of the third outer periphery sensor 33 has been reached.

When the second outer periphery sensor 32 or the third outer periphery sensor 33 detects a coin M, the control device 40 sets the rotational speed of the rotor 20 to a medium speed Vm which is lower than the high speed Vh. Note that the control device 40 may set the rotational speed of the rotor 20 to a medium speed Vm which is lower than the high speed Vh also when the first outer periphery sensor 31 detects a coin M. Further, the control device 40 may set the rotational speed of the rotor 20 to a different medium speed Vm depending on whether the outer periphery sensor 30 has detected a coin M. For example, the rotational speed of the rotor 20 is set to a different medium speed Vm depending on the distances at which the detection range of the outer periphery sensors 30 are located from the coin outlet 12*a* in the direction of the forward rotation of the rotor 20. Specifically, if the first outer periphery sensor 31 detects a coin M, the rotational speed of the rotor 20 is 85%, if the second outer periphery sensor 32 detects a coin M, then 80%, and if the third outer periphery sensor 33 detects a coin M, then 75%. Thus, by finely controlling the rotational speed of the rotor 20 based on the position of the coin M, the coin M can be efficiently fed out from the coin outlet 12*a*.

(3) When the rotational speed of the rotor is maintained at the medium speed Vm by the control device 40, the coins M are sequentially fed out from the coin outlet 12*a*. Then, unremarkably, when no coins M remain in the cylindrical portion 10, the control device 40 stops the rotation of the rotor 20.

(4) Incidentally, while a coin M is inserted inside the cylindrical portion 10 and the rotor 20 is rotating at medium speed Vm, the coin M may become jammed. Based on the knowledge that the jamming of the coin M mainly occurs in the vicinity of the coin outlet 12*a*, if the time (the number of consecutive detections detected in a predetermined time) that the third outer periphery sensor 33 continuously detects the coin M is long, the control device 40 reversely rotates the rotor 20 for a predetermined time, and thereafter, resets back to the forward rotation, and the jamming of the coin M is able to be eliminated. Note that as with the case of the third outer periphery sensor 33, the jamming of the coin M may be detected in the first outer periphery sensor 31 or the second outer periphery sensor 32.

(5) Also, a large amount of coins M may be inserted into the cylindrical portion 10 (see FIGS. 15, 16 and 17). If a large amount of coins M are inserted, and assuming the rotational speed of the rotor 20 is set to a low speed V1 (for example, 50%), based on the finding that the efficiency with which the coins M are fed out from the coin outlet 12*a* is improved, then because a large amount of coins M have been inserted, and the ON rate per unit time of the diameter sensor 50, the first outer periphery sensor 31 and the second outer periphery sensor 32 exceeds a threshold, the control device 40 sets the rotational speed of the rotor 20 to a low speed V1.

Thus, the control device 40 appropriately controls the rotation of the rotor 20 based on the state of the coins M located inside the cylindrical portion 10, so that the delivery efficiency of the coin M is high.

Second Embodiment

Next, a second configuration (hereinafter, referred to as a second embodiment) for carrying out the present invention will be described in detail with reference to the drawings. The coin batch loading device 1 of the second embodiment differs mainly from the coin batch loading device 1 of the first embodiment with respect to the determination process in the coin jam determination unit E which is a part of the rotor control is controlled by the control device 40, but since the other points remain in common, the description of the common points will be omitted.

As shown in FIG. 1, the coin batch loading device 1 of the second embodiment is the same as the coin batch loading device 1 of the first embodiment, and includes a cylindrical portion 10 with an insertion slot 13*a*, and a sorting unit 100 in communication with the coin outlet 12*a* of the cylindrical portion 10 to identify and sort the types of coins.

Then, coins inserted into the insertion slot 13*a* pass through into the inside of the cylindrical portion 10, and are fed out one at a time from the coin outlet 12*a*, and then based on the types of coins the sorting unit 100 is able to identify and sort the types of coins.

Here, the coin batch loading device 1 of the second embodiment includes a coin identification sensor (not shown) that can identify the type of coin fed out from the coin outlet 12*a* in the sorting unit 100.

The coin identification sensor used as an example includes a magnetic sensor composed of a plurality of coils disposed along the passage of coins going from the coin outlet 12*a* to the sorting unit 100 is used.

Then, when a coin passes by the coin identification sensor, the magnetic flux passing through the inside of the coils changes, and the voltage applied to the circuit of the magnetic sensor changes due to electromagnetic induction. Therefore, the coin identification sensor is able to identify the type of coin which passed by based on the comparison between the voltage changes and the previously provided set value for each type of coin.

Specifically, if a plurality of coins remain in a state of being overlapped in the vicinity of the coin identification sensor, the magnetic flux passing through the coils characteristically changes, and in accordance therewith, the voltage applied to the circuit of the magnetic sensor characteristically changes due to electromagnetic induction. Therefore, the coin identification sensor is able to identify whether or not a plurality of coins remain overlapped based on the characteristic changes in the voltage.

Particularly, when the sorting unit 100 identifies that a plurality of coins remain in an overlapping state in the area from the coin outlet 12*a* to the sorting unit 100, an ON signal is input from the sorting unit 100 into the control device 40.

Then, the coin batch loading device 1 of the second embodiment is the same as the coin batch loading device 1 of the first embodiment and includes a cylindrical portion 10 having an opening 10*a* at the top, a side wall 11 (see FIG. 17), and a bottom wall 12 (see FIG. 17), a rotor 20 is disposed inside the cylindrical portion 10 and rotates about the center of the cylindrical portion 10, outer periphery sensors 30 which are provided inside the cylindrical portion 10 for detecting coins on the outer periphery of the rotor 20, and a control device 40 (not shown) for controlling the rotation of the rotor 20.

The control device 40 of the coin batch loading device 1 according to the second embodiment performs the determination processing in the coin jam determination unit EE which is a part of the rotor control in the following manner.

Second Coin Jam Determination Unit

As shown in FIG. 5, if a coin jam is determined, the coin jam determination unit EE reversely rotates the rotor 20 for a predetermined time, and thereafter, a command signal for returning to forward rotation is output to the motor driver 60, or otherwise, a transition to the batch coin determination unit F is made.

Figure 18:
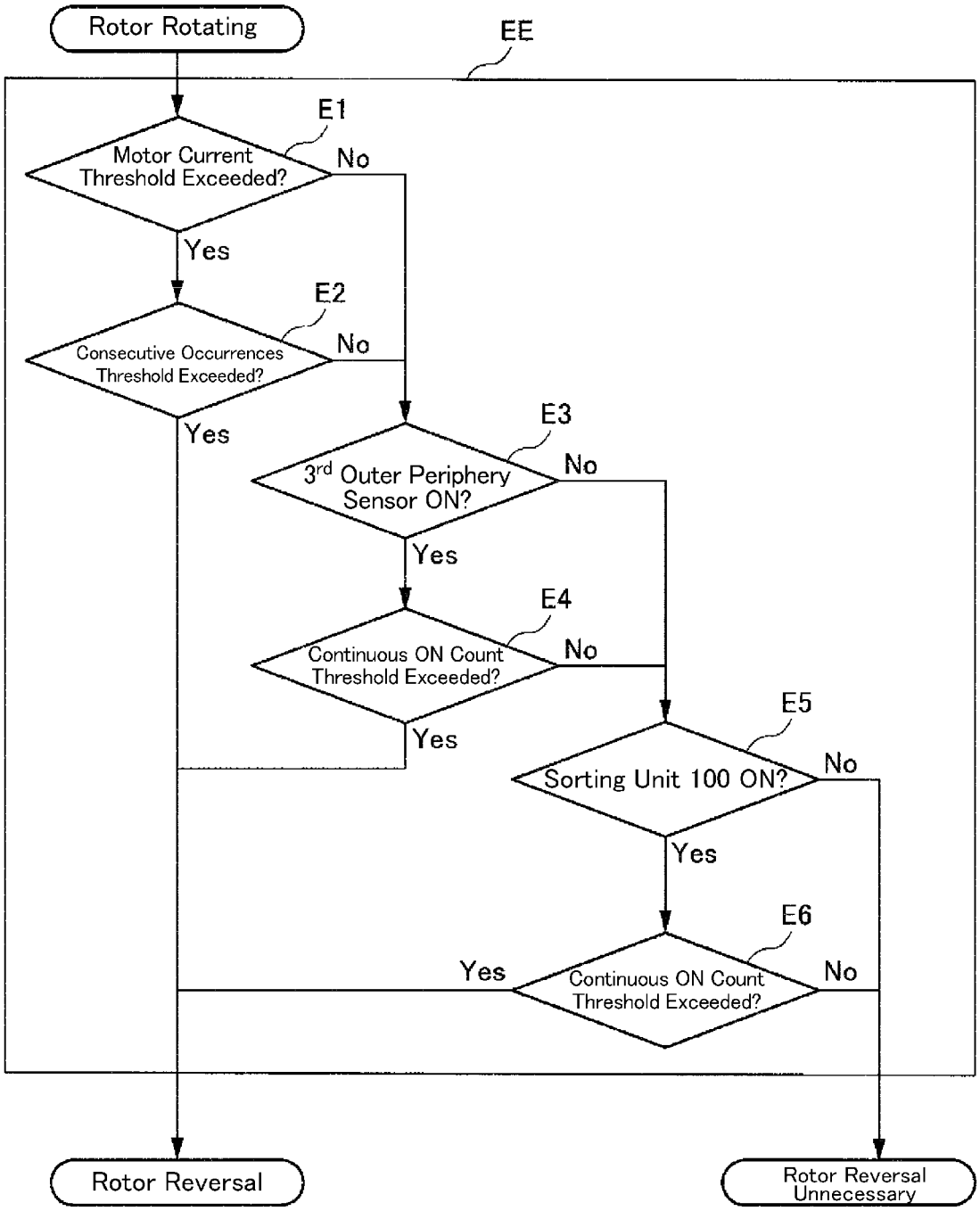
FIG. 18 is a control flow diagram showing processing details in a coin jam determination unit of a second embodiment.

In detail, as shown in FIG. 18, if the motor current i of the motor that drives the rotor 20 is determined to have exceeded a threshold (when the determination result of E1 is Yes), and if the number of consecutive occurrences (or times) is determined to have exceeded a threshold (if the determination result of E2 is Yes), then the coin jam determination unit EE reversely rotates the rotor 20 for a predetermined time, and then outputs a command signal for returning to the forward rotation to the motor driver 60.

Further, if the coin jam determination unit EE determines that the motor current i does not exceed the threshold (when the determination result of E1 is No), or if the number of times of continuous occurrence (or times) is determined not to have exceeded the threshold (when the determination result of E2 is No), then in determination unit E3, whether or not an ON signal has been input from the third outer periphery sensor 33 is determined.

If an ON signal is input from the third outer periphery sensor 33 (when the determination result of E3 is Yes), the determination unit E3 transitions to determination unit E4, and if an ON signal is not input from the third outer periphery sensor 33 (when the determination result of E3 is No), then a transition to determination unit E5 is made.

If the determination unit E4 determines that the number of consecutive ONs corresponding to the times when the third outer periphery sensor 33 continuously detects coins has exceeded the threshold (when the E4 determination result is Yes), then the rotor 20 is reversely rotated for a predetermined time, and then a command signal for returning to the forward rotation is output to the motor driver 60.

But if the determination unit E4 does not determine that the number of consecutive ONs corresponding to the time when the third outer periphery sensor 33 continuously detects coins has exceeded the threshold (when the determination result of E4 is No), a transition to determination unit E5 is made.

The determination unit E5 determines whether or not the coin identification sensor of the sorting unit 100 has identified that a plurality of coins remain in an overlapping state in the vicinity from the coin outlet 12*a* to the sorting unit 100, i.e. whether or not an ON signal is input from the sorting unit 100.

If an ON signal is input from the sorting unit 100 (when the determination result in E5 is Yes), then a transition to determination unit E6 is made.

If the determination unit E6 determines that the number of consecutive ONs corresponding to the time when the coin identification sensor of the sorting unit 100 continuously identified that a plurality of coins remained in an overlapped state in the area from the coin outlet 12*a* to the sorting unit 100 has exceeded the threshold (when the determination result of E6 is Yes), then the rotor is reversely rotated for a predetermined time, and thereafter a command signal for returning to the forward rotation is output to the motor driver 60.

If the motor driver 60 receives a command signal to reversely rotate the rotor 20, then the motor driver 60 reversely rotates the rotor 20. The rotational speed of the reverse rotation is equal to the high speed Vh of the rotational speed of forward rotation, and is, for example, 90% of the rotational speed when the maximum value of the rotational speed obtained from the motor output is 100%. By setting the rotational speed of the reverse rotation to the high speed Vh, the reverse rotation is able to be performed with a stronger force than that of the forward rotation at the medium speed Vm, and a coin jam is able to be eliminated.

Thus, the control device 40 uses not only the motor current i, but also the detection results of coins in the vicinity of the coin outlet 12*a* in the vicinity of the third outer periphery sensor 33, and moreover, because a coin jam is determined using the identification results of a state in which a plurality of coins are overlapped in the area from the coin outlet 12*a* to the sorting unit 100, coin jams in locations other than the internal part of cylindrical portion 10 are also able to be correctly detected.

Note that coin jam determination unit EE is not limited to the third outer periphery sensor 33, but if any of the plurality of outer periphery sensors 30 continuously detects a coin, the threshold value is exceeded, and a coin jam may be determined.

Then, if the control device 40 detects a coin continuously in any one of the plurality of outer periphery sensors 30 in the coin jam determination unit EE causing the threshold value to be exceeded, if the motor current i driving the rotor 20 exceeds the threshold value, or if the time in which the sorting unit 100 continuously identifies a state in which a plurality of coins are overlapped in the area from the coin outlet 12*a* to the sorting unit 100 causing the threshold value to be exceeded, then a coin jam is determined, and if a coin jam is determined, then the rotor 20 is reversely rotated for a predetermined time, and thereafter, returned to forward rotation. Thus, coin jams are able to be detected early and reliably.

As mentioned above, even though the preferred embodiments of this invention have been explained in full detail, the coin batch loading device according to the present invention is not limited to the embodiments described above, and various modifications and changes are possible within the scope of the subject matter of the present invention described in the claims.

According to the coin batch loading device of the present invention, because the control device is able to set the rotation speed of the rotor to be lower than a high speed and a medium speed if the outer periphery sensor detects a coin, when there are coins inside the cylindrical portion, the rotational speed of the rotor is able to be adjusted to the rotational speed at which the delivery efficiency is the highest.

According to the coin batch loading device of the present invention, the cylindrical portion has a lid that is able to be opened and closed with respect to the opening, and the lid has an insertion slot and insertion sensors that are able to detect that coins have been inserted; and then if the control device detects that coins have been inserted by means of the insertion sensors, because the rotational speed of the rotor is able to be increased until the outer periphery sensors detect a coin, the transit time of the coins from the coins being inserted into the insertion slot to the locations of the outer periphery sensors is able to shortened, and the delivery efficiency is able to be improved.

According to the coin batch loading device of the present invention, if the time in which the control device continuously detects coins in all of the plurality of outer periphery sensors exceeds a threshold, a coin jam is determined to have occurred, and if a coin jam is determined to have occurred, then because the rotor is reversely rotated for a predetermined time, and thereafter returned to forward rotation, the coin jam is able to be detected correctly, regardless of the rotation status or load status of the rotor, and coin jams are able to be reliably eliminated based on the detection.

According to the coin batch loading device of the present invention, because the outer periphery sensors comprise at least a first outer periphery sensor, a second outer periphery sensor and a third outer periphery sensor, regardless of where in the circumferential direction of the rotor the coins starts rotating, the fact that the coins have proceeded into the passage is able to be detected, and based on the detections, the rotor is able to be at an optimal speed for delivering coins.

According to the coin batch loading device of the present invention, because the third outer periphery sensor is disposed in the vicinity of the coin outlet, coin jams in the vicinity of the coin outlet are able to be reliably detected, and the rotor speed is able to be adjusted based on the detection so as to eliminate coin jams.

According to the coin batch loading device of the present invention, the cylindrical portion has a diameter sensor that detects coins above the rotor on the inner wall of the cylindrical portion, and if the time per unit time at which the control device detects a coin in all of the diameter sensor, the first outer periphery sensor, and the second outer periphery sensor exceeds a threshold value, a large amount of coins is determined to be present, and if the number of coins is determined to be large, because the rotational speed of the rotor is able to be set to a low speed lower than the medium speed, a large number of coins is able to be detected, and based on that detection, the rotor is able to slowed to an appropriate speed for a large amount of coins.

According to the invention, because the time at which coins were continuously detected in all of the plurality of outer periphery sensors, or the time per unit time at which coins were detected in all of the diameter sensor, the first outer periphery sensor, and the second outer periphery sensor is the number of detections performed in a predetermined cycle, the calculated result obtained by multiplying the fixed period with the number of detections is able to be replaced with the detected time or the time per unit time without detecting continuously.

The invention claimed is:

1. A coin batch loading device capable of separating out coins one by one which were input as a batch and delivering them comprising:

a cylindrical portion having an opening at the top and a side wall and a bottom wall, a rotor which is disposed inside the cylindrical portion and whose center of rotation is the rotation center of the cylindrical portion, outer periphery sensors provided inside the cylindrical portion configured to detect the presence of one or more coins on an outer perimeter portion of the rotor, and a control device configured to control the rotation of the rotor, wherein the outer periphery sensors comprise at least a first outer periphery sensor, a second outer periphery sensor, and a third outer periphery sensor that are spaced apart from one another in the circumferential direction of the cylindrical portion, wherein if one or more outer periphery sensors detect one or more coins, the control device is configured to set the rotational speed of the rotor to a medium speed in a forward direction which is lower than a high speed, and wherein the control device is configured to set the rotational speed of the rotor to a different medium speed depending on the distances at which the detection range of the outer periphery sensors are located from a coin outlet in the direction of the forward rotation of the rotor.

2. The coin batch loading device according to claim 1:

wherein the cylindrical portion includes a lid which is able to be opened and closed with respect to the opening, wherein the lid has an insertion slot and one or more insertion sensors which detect that one or more coins have been inserted, and wherein if the one or more insertion sensors detect the insertion of one or more coins, the control device is able to set the rotational speed of the rotor to a high speed until the outer periphery sensors detects one or more coins.

3. The coin batch loading device according to claim 1, wherein the outer periphery sensors are spaced apart from one another in the circumferential direction of the cylindrical portion, and wherein if in any one of the plurality of outer periphery sensors the time in which one or more coins are continuously detected exceeds a threshold, a coin jam is determined to have occurred, and if a coin jam is determined to have occurred, then the control device reversely rotates the rotor for a predetermined time and thereafter returns the rotor to forward rotation.

4. The coin batch loading device according to claim 1, wherein the outer periphery sensors are spaced apart from one another in the circumferential direction of the cylindrical portion, and wherein if in any one of the plurality of outer periphery sensors the time in which one or more coins is continuously detected exceeds a threshold value, or if a motor current driving the rotor exceeds a threshold, a coin jam is determined to have occurred, and if a coin jam is determined to have occurred, the control device reversely rotates the rotor for a predetermined time and thereafter returns the rotor to forward rotation.

5. The coin batch loading device according to claim 1, wherein the third outer periphery sensor is disposed nearest to the coin outlet and the first outer periphery sensor is disposed furthest from the coin outlet, among the first outer periphery sensor, the second outer periphery sensor, and the third outer periphery sensor, wherein the control device is configured to set the rotational speed of the rotor to a first medium speed if the first outer periphery sensor detects one or more coins, a second medium speed if the second outer periphery sensor detects one or more coins, the second medium speed being slower than the first medium speed, and a third medium speed if the third outer periphery sensor detects one or more coins, the third medium speed being slower than the second medium speed.

6. The coin batch loading device according to claim 1, wherein for the cylindrical portion, a diameter sensor is provided inside the cylindrical portion for detecting one or more coins above the rotor, and if the time per unit time during which one or more coins are detected in all of the diameter sensor, the first outer periphery sensor, and the second outer periphery sensor exceeds a threshold, a large amount of coins is determined to be present, and if a large amount of coins is determined to be present, then the control device is able to set the rotational speed of the rotor to be lower than medium speed.

7. The coin batch loading device according to claim 3, wherein the time is determined based on the number of detections performed in a predetermined cycle.

8. The coin batch loading device according to claim 1, wherein the coin batch loading device includes a sorting unit that communicates with a coin outlet of the cylindrical portion and capable of identifying one or more coins' type, wherein the outer periphery sensors are spaced apart from one another in the circumferential direction of the cylindrical portion, and wherein if in any one of the plurality of outer periphery sensors the time when one or more coins is continuously detected exceeds a threshold, if a motor current driving the rotor exceeds a threshold, or if the time in which the sorting unit continuously identifies a state in which a plurality of coins overlap in the vicinity from the coin outlet to the sorting unit exceeds a threshold, then a coin jam is determined to have occurred, and if a coin jam is determined to have occurred, then the control device reversely rotates the rotor for a predetermined time and thereafter returns the rotor to forward rotation.

* * * * *